US010267540B2

(12) United States Patent
Minami et al.

(10) Patent No.: US 10,267,540 B2
(45) Date of Patent: Apr. 23, 2019

(54) HEAT SOURCE UNIT

(71) Applicant: DAIKIN INDUSTRIES, LTD., Osaka-shi, Osaka (JP)

(72) Inventors: Junya Minami, Sakai (JP); Masahiro Oka, Sakai (JP); Mari Susaki, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 249 days.

(21) Appl. No.: 15/114,372

(22) PCT Filed: Jan. 29, 2015

(86) PCT No.: PCT/JP2015/052524

§ 371 (c)(1),
(2) Date: Jul. 26, 2016

(87) PCT Pub. No.: WO2015/115546

PCT Pub. Date: Aug. 6, 2015

(65) Prior Publication Data

US 2016/0341450 A1 Nov. 24, 2016

(30) Foreign Application Priority Data

Jan. 31, 2014 (JP) ..... 2014-017984

(51) Int. Cl.
*F25B 5/02* (2006.01)
*F25B 49/02* (2006.01)
*F25B 13/00* (2006.01)

(52) U.S. Cl.
CPC ..... *F25B 5/02* (2013.01); *F25B 49/02* (2013.01); *F25B 49/022* (2013.01); *F25B 13/00* (2013.01);
(Continued)

(58) Field of Classification Search
CPC F25B 5/02; F25B 2600/2513; F25B 2313/05; F25B 2313/025;
(Continued)

(56) References Cited

U.S. PATENT DOCUMENTS

2006/0162355 A1* 7/2006 Nakayama ..... F25B 49/027 62/183
2010/0205987 A1* 8/2010 Okazaki ..... F25B 9/008 62/190
(Continued)

FOREIGN PATENT DOCUMENTS

EP 2 068 101 A 8/2007
JP 2006-29734 A 2/2006
(Continued)

OTHER PUBLICATIONS

English Translation of JP2008292073A.*
(Continued)

*Primary Examiner* — Frantz F Jules
*Assistant Examiner* — Schyler S Sanks
(74) *Attorney, Agent, or Firm* — Global IP Counselors, LLP

(57) ABSTRACT

A heat source unit includes a compressor, first and second heat exchangers connected in parallel, first and second motor-operated valves regulating amounts of refrigerant that flow to the first and second heat exchangers, first and second temperature sensors measuring temperatures of refrigerant flowing from the first and second motor-operated valve to the first and second heat exchangers, a discharge temperature sensor measuring temperature of refrigerant discharged from the compressor, and a valve opening controller. The controller regulates valve openings of the first and second motor-operated valves based on the discharge temperature, refrigerant temperature detected by the first temperature sensor and refrigerant temperature detected by the second temperature sensor.

19 Claims, 11 Drawing Sheets

(52) U.S. Cl.
CPC ... *F25B 2313/007* (2013.01); *F25B 2313/027* (2013.01); *F25B 2313/0233* (2013.01); *F25B 2313/0253* (2013.01); *F25B 2400/13* (2013.01); *F25B 2600/2513* (2013.01); *F25B 2700/1933* (2013.01); *F25B 2700/2117* (2013.01); *F25B 2700/21152* (2013.01); *F25B 2700/21174* (2013.01); *F25B 2700/21175* (2013.01)

(58) Field of Classification Search
CPC .... F25B 2313/0253; F25B 2313/02533; F25B 2700/1933; F25B 2700/21174; F25B 2700/2117; F25B 2700/21172; F25B 2700/21152; F25B 2700/21173
See application file for complete search history.

(56) References Cited

U.S. PATENT DOCUMENTS

2012/0260685 A1* 10/2012 Honda ..... F24F 3/06 62/160
2013/0180474 A1* 7/2013 Wilhelm ..... F28F 9/013 122/406.4
2015/0121718 A1* 5/2015 Huang ..... D06F 58/28 34/476

FOREIGN PATENT DOCUMENTS

JP 2007-255738 A 10/2007
JP 2008292073 A * 12/2008
JP 2013-210160 A 10/2013

OTHER PUBLICATIONS

A Review of Refrigeration Methods in the Temperature Range 4-300K, Chakravarthy et. al., Jun. 2011, Journal of Thermal Science and Engineering Applications, vol. 3.*
European Search Report of corresponding EP Application No. 15 74 2796.4 dated Feb. 10, 2017.
International Search Report of corresponding PCT Application No. PCT/JP2015/052524 dated Apr. 21, 2015.
International Preliminary Report of corresponding PCT Application No. PCT/JP2015/052524 dated Aug. 11, 2016.

* cited by examiner

HEAT SOURCE UNIT

CROSS-REFERENCE TO RELATED APPLICATIONS

This U.S. National stage application claims priority under 35 U.S.C. § 119(a) to Japanese Patent Application No. 2014-017984, filed in Japan on Jan. 31, 2014, the entire contents of which are hereby incorporated herein by reference.

TECHNICAL FIELD

The present invention relates to a refrigeration apparatus.

BACKGROUND ART

In the prior art, a refrigerating apparatus has been proposed in which a plurality of heat exchangers are mutually connected in parallel, wherein a flow-rate-regulating valve is provided to each heat exchanger and the flow rate of the refrigerant to the heat exchangers is adjusted.

For example, it is has been proposed in Japanese Laid-open Patent Application No. 2006-29734 to control the opening of the flow-rate-regulating valves so that the temperatures of the refrigerant flowing through the outlets of the heat exchangers are equal, and thereby maintain an optimal refrigeration cycle. Specifically, the temperature of the refrigerant flowing through the outlets of the heat exchangers can be equalized by performing control in which the total valve opening of the plurality of flow-rate-regulating valves is established on the basis of the frequency and target discharge temperature of the compressor, and when the temperature difference of the outlet refrigerant of the heat exchangers has exceeded a predetermined value, the valve opening of the flow-rate-regulating valve of the heat exchanger having a higher outlet temperature is opened by a predetermined amount, and the valve opening of the flow-rate-regulating valve of the heat exchanger having a lower outlet temperature is closed by a predetermined amount.

SUMMARY

Technical Problem

In the refrigerating apparatus described in Japanese Laid-open Patent Application No. 2006-29734 as described above, the temperature difference of the refrigerant flowing through the outlet of the heat exchangers is ascertained, and the opening of the expansion valve connected to the heat exchangers is controlled so that the temperature difference is eliminated and the degree of superheating is kept constant. Thus, the refrigerant flowing through the outlets of the heat exchangers is a refrigerant in a gas state with a degree of superheating and, though heat energy is obtained, is therefore different from the refrigerant in a gas-liquid two-phase state in which the heat energy is consumed in order to cause the liquid refrigerant to be evaporated as latent heat of vaporization, and the heat energy obtained near the outlets of the heat exchangers is entirely consumed as sensible heat for increasing the temperature of the gas refrigerant. Therefore, the temperature of the refrigerant flowing through the outlets of the heat exchangers tends to undergo considerable fluctuation.

Accordingly, it is difficult to rapidly regulate the valve opening so as to be able to follow changes in the temperature of the refrigerant flowing through outlets of the heat exchangers when attempting to adjust the opening of the expansion valves on the basis of the temperature difference of the refrigerant flowing through the outlets of the heat exchangers as in the refrigerating apparatus described in Japanese Laid-open Patent Application No. 2006-29734.

The present invention was devised in view of the above-noted drawbacks, it being an object of the present invention to provide a heat source unit capable of demonstrating sufficient capability by stable regulation of the valve opening of motor-operated valves provided in corresponding fashion to each of a plurality of heat exchangers mutually connected in parallel.

Solution to Problem

A heat source unit according to a first aspect is connected to usage units and thereby constitutes a refrigerant circuit, the heat source unit comprising a compressor, a first heat exchanger, a second heat exchanger, a first motor-operated valve, a second motor-operated valve, a first temperature sensor, a second temperature sensor, a discharge temperature sensor, and a valve opening controller. The second heat exchanger is connected in parallel to the first heat exchanger. The first motor-operated valve regulates the amount of refrigerant that flows to the first heat exchanger when the first heat exchanger functions as a refrigerant evaporator. The second motor-operated valve regulates the amount of refrigerant that flows to the second heat exchanger when the second heat exchanger functions a refrigerant evaporator. The first temperature sensor measures the temperature of refrigerant that flows from the first motor-operated valve to the first heat exchanger. The second temperature sensor measures the temperature of refrigerant that flows from the second motor-operated valve to the second heat exchanger. The discharge temperature sensor measures the temperature of refrigerant discharged from the compressor. The valve opening controller regulates a valve opening of the first motor-operated valve and the second motor-operated valve on the basis of the discharge temperature. The valve opening controller regulates the valve opening of the first motor-operated valve and the valve opening of the second motor-operated valve on the basis of at least the value of the refrigerant temperature detected by the first temperature sensor and the value of the refrigerant temperature detected by the second temperature sensor.

In this heat source unit, the total flow rate of the first heat exchanger and the second heat exchanger is established on the basis of the discharge temperature ascertained from the discharge temperature sensor, and it is possible to establish distribution of the flow rate through the first motor-operated valve and the second motor-operated valve when attempting to ensure the most broad area in which the refrigerant evaporates and obtain effective utilization for either the first heat exchanger and the second heat exchanger on the basis of at least the value of the refrigerant temperature detected by the first temperature sensor and the value of the refrigerant temperature detected by the second temperature sensor. The first temperature sensor measures the temperature of the refrigerant that flows from the first motor-operated valve to the first heat exchanger, and the second temperature sensor measures the temperature of the refrigerant that flows from the second motor-operated valve to the second heat exchanger. Therefore, both temperature sensors detect the temperature of refrigerant in a gas-liquid two-phase state decompressed in the motor-operated valve. Even if heat energy is added to the refrigerant in such a gas-liquid two-phase state, the heat energy is merely consumed as latent heat for causing a portion of the liquid refrigerant to evaporate, and the temperature of the refrigerant is unlikely to vary. Therefore, the temperatures measured by the first temperature sensor and the second temperature sensor are stable and are not liable to vary, and the valve opening of the first motor-operated valve and the second motor-operated valve controlled on the basis thereof can therefore be made less likely to undergo considerable change and regulation of the valve opening can be facilitated. Consequently, sufficient capability can be demonstrated in both the first heat exchanger and the second heat exchanger while the relationship between the valve opening of the first motor-operated valve and the valve opening of the second motor-operated valve is stably regulated in accordance with the value of the refrigerant temperature detected by the first temperature sensor for measuring the stable refrigerant temperature, and the value of the refrigerant temperature detected by the second temperature sensor for measuring the stable refrigerant temperature.

A heat source unit according to a second aspect is the heat source unit according to the first aspect, further comprising an intake pressure sensor for measuring the pressure of refrigerant taken in by compressor. The valve opening controller regulates the valve opening of the first motor-operated valve and the valve opening of the second motor-operated valve on the basis of further the intake pressure sensor.

Generally, when attempting to perform control with the aim of bringing the refrigerant flowing through the outlet of the first heat exchanger and the refrigerant flowing through the outlet of the second heat exchanger to a state of saturation, the refrigerant flowing out from the first heat exchanger and/or the second heat exchanger may be in a gas-liquid two-phase state, and it may become difficult to perform control because the state of the refrigerant cannot be ascertained merely from the intake temperature information.

In contrast, in the heat source unit, the flow rate in the first heat exchanger and the second heat exchanger is regulated using the intake pressure information, the temperature equivalent pressure information from the first temperature sensor, and the temperature equivalent pressure information from the second temperature sensor, and the refrigerant flowing through the outlet of the first heat exchanger and the refrigerant flowing through the outlet of the second heat exchanger can thereby be rapidly brought to a state of saturation without difficult control.

A heat source unit according to a third aspect is the heat source unit according to the second aspect, wherein the valve opening controller regulates the valve opening of the first motor-operated valve and the valve opening of the second motor-operated valve on the basis of the difference between the refrigerant pressure equivalent to the temperature detected by the first temperature sensor and the pressure detected by the intake pressure sensor, and the difference between the refrigerant pressure equivalent to the temperature detected by the second temperature sensor and the pressure detected by the intake pressure sensor.

In this heat source unit, it is possible to bring the refrigerant flowing through the outlet of the first heat exchanger and the refrigerant flowing through the outlet of the second heat exchanger near to a state of saturation with greater accuracy using a relationship in which the pressure difference (pressure loss) before and after the first heat exchanger and the second heat exchanger is proportional to the square of the flow rate.

A heat source unit according to a fourth aspect is the heat source unit according to the first aspect, further comprising an intake temperature sensor for measuring the temperature of refrigerant taken in by the compressor. The valve opening controller regulates the valve opening of the first motor-operated valve and the valve opening of the second motor-operated valve on the basis of the difference between the refrigerant pressure equivalent to the temperature detected by the first temperature sensor and the refrigerant pressure equivalent to the temperature detected by the intake temperature sensor, and the difference between the refrigerant pressure equivalent to the temperature detected by the second temperature sensor and the refrigerant pressure equivalent to the temperature detected by the intake temperature sensor.

In this heat source unit, it is possible to bring the refrigerant flowing through the outlet of the first heat exchanger and the refrigerant flowing through the outlet of the second heat exchanger near to a state of saturation with greater accuracy using a relationship in which the pressure difference (pressure loss) before and after the first heat exchanger and the second heat exchanger is proportional to the square of the flow rate.

A heat source unit according to a fifth aspect is the heat source unit according to the second aspect, further comprising a first intermediate temperature sensor for measuring the temperature of refrigerant flowing through the interior of the first heat exchanger and a second intermediate temperature sensor for measuring the temperature of refrigerant flowing through the interior of the second heat exchanger. The valve opening controller regulates the valve opening of the first motor-operated valve and the valve opening of the second motor-operated valve on the basis of the difference between the refrigerant pressure equivalent to the temperature detected by the first intermediate temperature sensor and the pressure detected by the intake pressure sensor, and the difference between the refrigerant pressure equivalent to the temperature detected by the second intermediate temperature sensor and the pressure detected by the intake pressure sensor.

In this heat source unit, it is possible to bring the refrigerant flowing through the outlet of the first heat exchanger and the refrigerant flowing through the outlet of the second heat exchanger near to a state of saturation with greater accuracy using a relationship in which the pressure difference (pressure loss) before and after the first heat exchanger and the second heat exchanger is proportional to the square of the flow rate.

A heat source unit according to a sixth aspect is the heat source unit according to the first aspect, further comprising: a first intermediate temperature sensor for measuring the temperature of refrigerant flowing through the interior of the first heat exchanger and a second intermediate temperature sensor for measuring the temperature of refrigerant flowing through the interior of the second heat exchanger; and an intake temperature sensor for measuring the temperature of refrigerant taken in by the compressor. The valve opening controller regulates the valve opening of the first motor-operated valve and the valve opening of the second motor-operated valve on the basis of the difference between the refrigerant pressure equivalent to the temperature detected by the first intermediate temperature sensor and the refrigerant pressure equivalent to the temperature detected by the intake temperature sensor, and the difference between the refrigerant pressure equivalent to the temperature detected by the second intermediate temperature sensor and the refrigerant pressure equivalent to the temperature detected by the intake temperature sensor.

In this heat source unit, it is possible to bring the refrigerant flowing through the outlet of the first heat exchanger and the refrigerant flowing through the outlet of the second heat exchanger near to a state of saturation with greater accuracy using a relationship in which the pressure difference (pressure loss) before and after the first heat exchanger and the second heat exchanger is proportional to the square of the flow rate.

A heat source unit according to a seventh aspect is the heat source unit according to any of the third to sixth aspects, wherein the valve opening controller regulates the valve opening of the first motor-operated valve and the valve opening of the second motor-operated valve so that the pressure loss of refrigerant passing through the first heat exchanger and the pressure loss of refrigerant passing through the second heat exchanger are equivalent.

In this heat source unit, the pressure difference (pressure loss) before and after the first heat exchanger and the second heat exchanger is controlled so as to be equivalent, and optimizing the distribution of refrigerant to the first heat exchanger and the second heat exchanger makes it possible to enhance heat exchange performance.

A heat source unit according to an eighth aspect is the heat source unit according to the first aspect, wherein the valve opening controller regulates the valve opening of the first motor-operated valve and the valve opening of the second motor-operated valve so that the refrigerant temperature detected by the first temperature sensor and the refrigerant temperature detected by the second temperature sensor maintain the same temperature.

In this heat source unit, it is possible to equalize the temperature of the refrigerant that has been decompressed by the first motor-operated valve and that thereafter moves toward the first heat-source-side heat exchanger and the temperature of the refrigerant that has been decompressed by the second motor-operated valve and that thereafter moves toward the second heat-source-side heat exchanger, and to cause both the first heat exchanger and the second heat exchanger to demonstrate sufficient capability.

A heat source unit according to a ninth aspect is the heat source unit according to any of the first to eighth aspects, further comprising a third temperature sensor and a fourth temperature sensor. The third temperature sensor detects the temperature of refrigerant flowing through the outlet of the first heat exchanger when the first heat exchanger functions as a refrigerant evaporator. The fourth temperature sensor detects the temperature of refrigerant flowing through the outlet of the second heat exchanger when the second heat exchanger functions as a refrigerant evaporator. The valve opening controller regulates the valve opening of the first motor-operated valve and the valve opening of the second motor-operated valve so that the refrigerant flowing through the outlet of the first heat exchanger and the refrigerant flowing through the outlet of the second heat exchanger each have a predetermined degree of superheating in an interval from the start of operation for causing the first heat exchanger and the second heat exchanger to function as refrigerant evaporators until a predetermined stabilization condition is satisfied, and regulates the valve opening of the first motor-operated valve and the valve opening of the second motor-operated valve on the basis of the discharge temperature after the predetermined stabilization condition has been satisfied.

In this heat source unit, the valve opening control for the first motor-operated valve and the second motor-operated valve based on the discharge temperature is started after the refrigerant in the outlet of the first heat exchanger and the refrigerant in the outlet of the second heat exchanger have been stabilized in a state having a degree of superheating. It is thereby possible to bring the refrigerant in the outlet of the first heat exchanger and the second heat exchanger near to a state of saturation while the degree of superheating in a stabilized state is gradually reduced, and it is possible to cause both the first heat exchanger and the second heat exchanger to reach as rapidly as possible a situation in which sufficient capability can be demonstrated while the intake of liquid refrigerant by the compressor is avoided.

Advantageous Effects of Invention

In the heat source unit according to the first aspect, sufficient capability can be demonstrated in both the first heat exchanger and the second heat exchanger while the relationship between the valve opening of the first motor-operated valve and the valve opening of the second motor-operated valve is stably regulated in accordance with the value of the refrigerant temperature detected by the first temperature sensor for measuring the stable refrigerant temperature, and the value of the refrigerant temperature detected by the second temperature sensor for measuring the stable refrigerant temperature.

In the heat source unit according to the second aspect, the refrigerant flowing through the outlet of the first heat exchanger and the refrigerant flowing through the outlet of the second heat exchanger can be rapidly brought to a state of saturation without difficult control.

In the heat source unit according to the third to sixth aspects, it is possible to bring the refrigerant flowing through the outlet of the first heat exchanger and the refrigerant flowing through the outlet of the second heat exchanger near to a state of saturation with greater accuracy.

In the heat source unit according to the seventh aspect, optimizing the distribution of refrigerant to the first heat exchanger and the second heat exchanger makes it possible to enhance heat exchange performance.

In the heat source unit according to the eighth aspect, it is possible to equalize the temperature of the refrigerant that has been decompressed by the first motor-operated valve and that thereafter moves toward the first heat-source-side heat exchanger and the temperature of the refrigerant that has been decompressed by the second motor-operated valve and that thereafter moves toward the second heat-source-side heat exchanger, and to cause both the first heat exchanger and the second heat exchanger to demonstrate sufficient capability.

In the heat source unit according to the ninth aspect, it is possible to cause both the first heat exchanger and the second heat exchanger to reach as rapidly as possible a situation in which sufficient capability can be demonstrated while the intake of liquid refrigerant by the compressor is avoided.

DESCRIPTION OF EMBODIMENTS

Embodiments of the refrigerating apparatus pertaining to the present invention are described below with reference to the accompanying drawings. The specific configuration of the refrigeration apparatus according to the present invention is not limited to the following embodiment and modification, and can be changed within a range that does not deviate from the scope of the invention.

(1) Configuration of Refrigeration Apparatus

Figure 1:
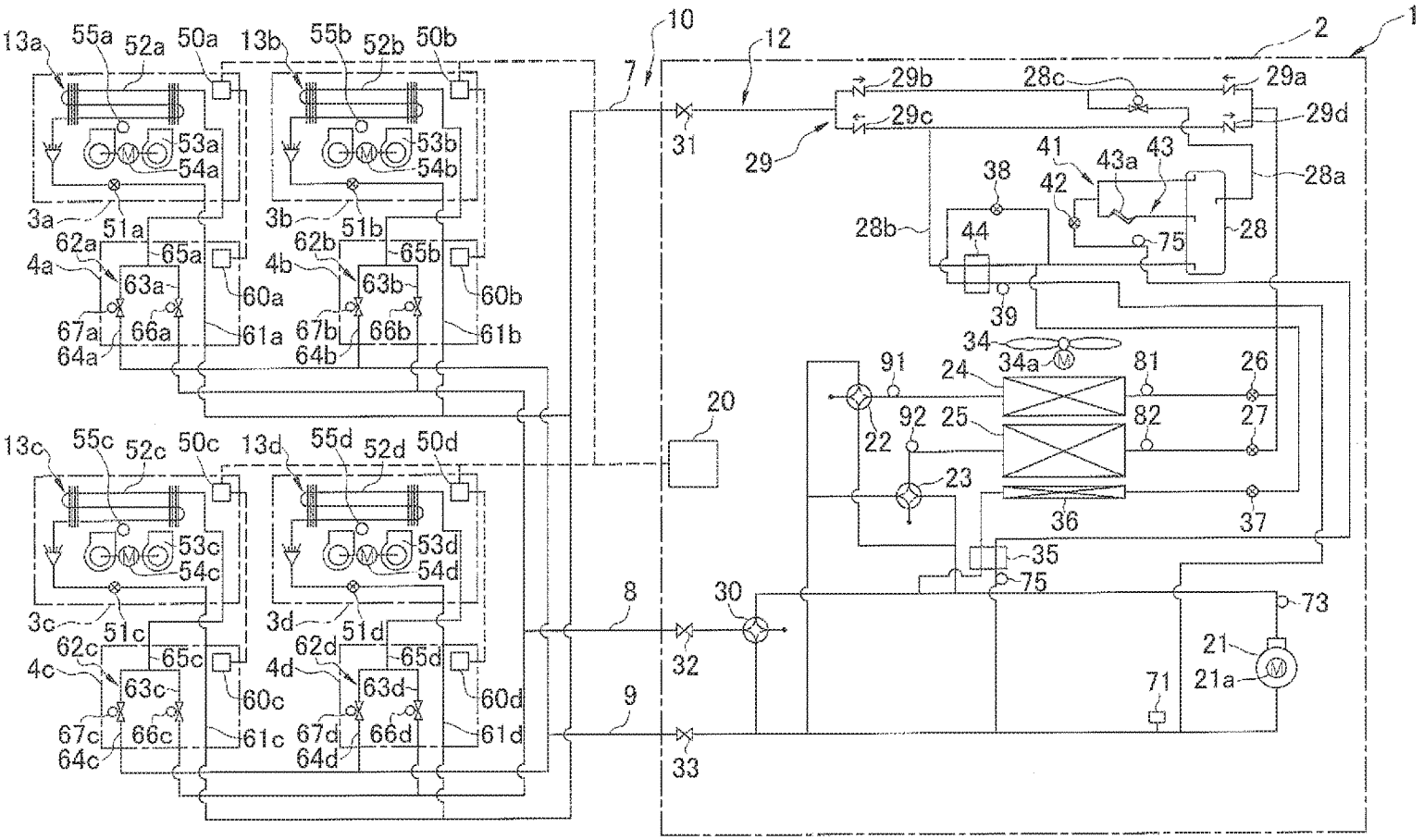
FIG. 1 is a schematic configuration diagram of the refrigerating apparatus as an embodiment of the refrigerating apparatus pertaining to the present invention.
Figure 2:
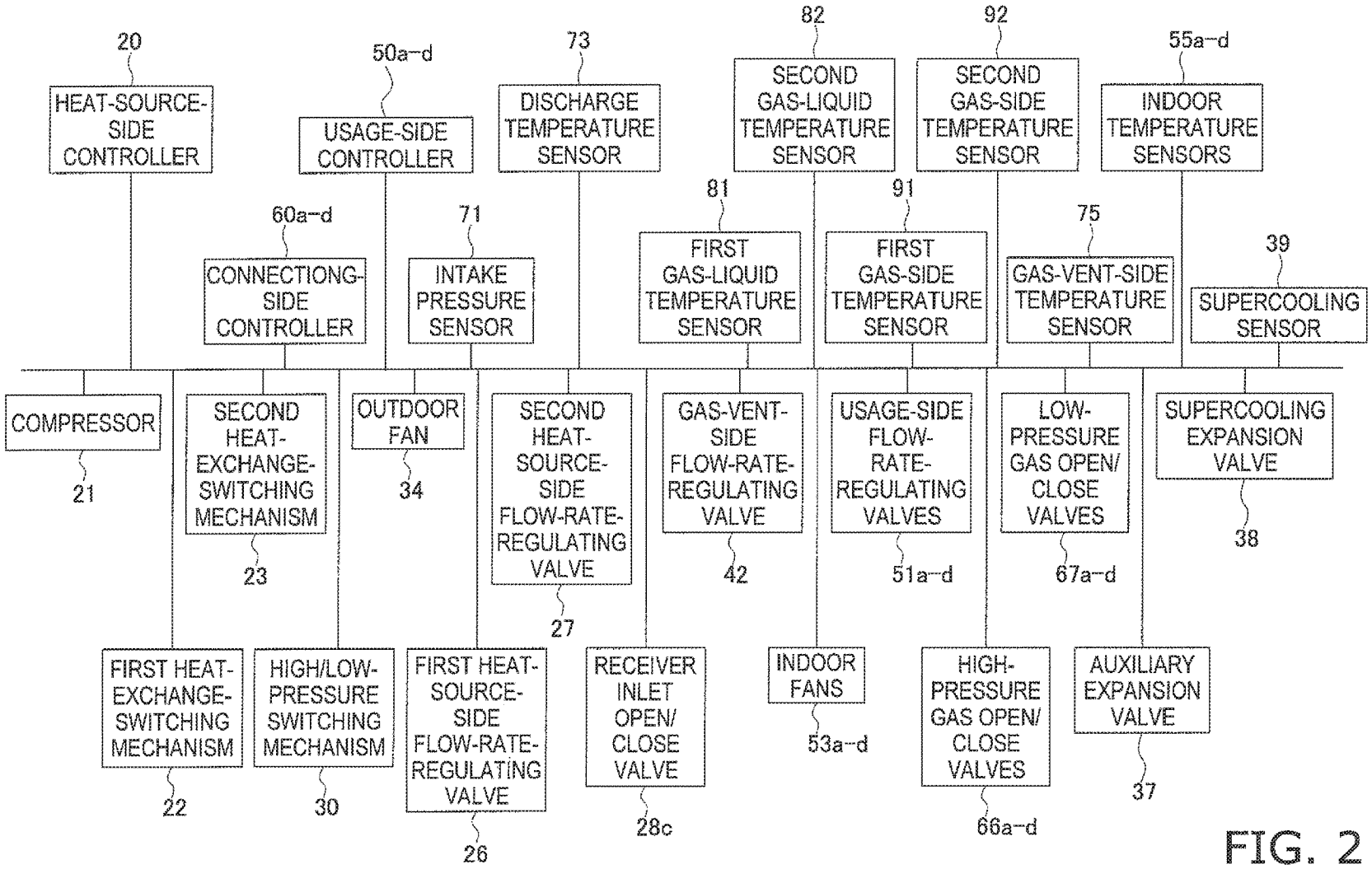
FIG. 2 is a block configuration diagram of the refrigerating apparatus.

FIG. 1 is a schematic configuration diagram of the refrigerating apparatus 1 as an embodiment of the refrigerating apparatus pertaining to the present invention. FIG. 2 is a block configuration diagram of the refrigerating apparatus 1. The refrigerating apparatus 1 is used for indoor air cooling/heating in a building or the like by performing a gas-compression-type refrigerating cycle.

The refrigerating apparatus 1 mainly has a single heat source unit 2, a plurality of (four in this embodiment) usage units 3*a*, 3*b*, 3*c*, 3*d*, connection units 4*a*, 4*b*, 4*c*, 4*d* connected to the usage units 3*a*, 3*b*, 3*c*, 3*d*, and refrigerant communicating tubes 7, 8, 9 for connecting the heat source unit 2 and the usage units 3*a*, 3*b*, 3*c*, 3*d* via the connection units 4*a*, 4*b*, 4*c*, 4*d*. In other words, a gas-compression-type refrigerant circuit 10 of the refrigerating apparatus 1 is composed of a heat source unit 2, usage units 3*a*, 3*b*, 3*c*, 3*d*, connection units 4*a*, 4*b*, 4*c*, 4*d*, and refrigerant communicating tubes 7, 8, 9. The refrigerating apparatus 1 is configured so that the usage units 3*a*, 3*b*, 3*c*, 3*d* are capable of individually performing an air-cooling operation or an air-warming operation, and is capable of recovering heat between the usage units by sending refrigerant to a usage unit that is performing an air-warming operation to an usage unit that is performing an air-cooling operation (in the present embodiment, a simultaneous air-cooling and air-warming operation is carried out for simultaneously performing an air-cooling operation and an air-warming operation.). Furthermore, the refrigerating apparatus 1 is configured so that the heat load of the heat source unit 2 is rebalanced in accordance with the overall heat load of the plurality of usage units 3*a*, 3*b*, 3*c*, 3*d* with consideration also given to the above-noted heat recovery (simultaneous air-cooling and air-warming operation).

(1-1) Usage Units

The usage units 3*a*, 3*b*, 3*c*, 3*d* are installed by being built into or suspended from an indoor ceiling of a building or the like, by hanging on an indoor wall surface, or by other means. The usage units 3*a*, 3*b*, 3*c*, 3*d* are connected to the heat source unit 2 via the refrigerant communicating tubes 7, 8, 9 and the connecting units 4*a*, 4*b*, 4*c*, 4*d*, and constitute a portion of the refrigerant circuit 10.

The configuration of the usage units 3*a*, 3*b*, 3*c*, 3*d* will next be described.

The usage unit 3*a* and the usage units 3*b*, 3*c*, 3*d* have the same configuration. Therefore, only the configuration of the usage unit 3*a* will be described. To refer to the configuration of the usage units 3*b*, 3*c*, 3*d*, the subscripts "b," "c," and "d" are added instead of "a" to the reference signs for indicating the components of the usage unit 3*a*, and the components of the usage units 3*b*, 3*c*, 3*d* will not be described.

The usage unit 3*a* primarily constitutes a portion of the refrigerant circuit 10 and has a usage-side refrigerant circuit 13*a* (usage-side refrigerant circuits 13*b*, 13*c*, 13*d* in the usage units 3*b*, 3*c*, 3*d*, respectively). The usage-side refrigerant circuit 13*a* has primarily a usage-side flow-rate-regulating valve 51*a* and a usage-side heat exchanger 52*a*.

The usage-side flow-rate-regulating valve 51*a* is a motor-operated expansion valve, the opening degree of which can be regulated, connected to a liquid side of the usage-side heat exchanger 52*a* in order to perform, inter alia, regulation of the flow rate of refrigerant flowing through the usage-side heat exchanger 52*a*.

The usage-side heat exchanger 52*a* is a device for exchanging heat between the refrigerant and indoor air, and comprises a fin-and-tube heat exchanger configured from a plurality of heat transfer tubes and fins, for example. Here, the usage unit 3*a* has an indoor fan 53*a* for drawing indoor air into the unit and supplying the air indoors as supply air after heat is exchanged, and is capable of causing heat to be exchanged between the indoor air and the refrigerant flowing through the usage-side heat exchanger 52*a*. The indoor fan 53*a* is driven by an indoor fan motor 54*a*.

The usage unit 3*a* has a usage-side controller 50*a* for controlling the operation of the components 51*a*, 54*a* constituting the usage unit 3*a*. The usage-side controller 50*a* has a microcomputer and/or memory for controlling the usage unit 3*a*, and is configured so as to be capable of exchanging control signals and the like with a remote control (not shown), and exchanging control signals and the like with the heat source unit 2.

(1-2) Heat Source Unit

The heat source unit 2 is installed on the roof or elsewhere in a building or the like, is connected to the usage units 3*a*, 3*b*, 3*c*, 3*d* via the refrigerant communicating tubes 7, 8, 9, and constitutes the refrigerant circuit 10 with the usage units 3*a*, 3*b*, 3*c*, 3*d*.

The configuration of the heat source unit 2 will next be described.

The heat source unit 2 primarily constitutes a portion of the refrigerant circuit 10 and has a heat-source-side refrigerant circuit 12. The heat-source-side refrigerant circuit 12 mainly has a compressor 21, a plurality (two, in the present embodiment) of switching mechanisms 22, 23, a plurality (two, in the present embodiment) of heat-source-side heat exchangers 24, 25, a first heat-source-side flow-rate-regulating valve 26 and a second heat-source-side flow-rate-regulating valve 27 associated with the heat-source-side heat exchangers 24, 25, a receiver 28, a bridge circuit 29, a high/low-pressure switching mechanism 30, a liquid-side shut-off valve 31, a high/low-pressure gas-side shut-off valve 32, a low-pressure gas-side shut-off valve 33, a double-tube heat exchanger 35, an auxiliary heat-source-side heat exchanger 36, an auxiliary expansion valve 37, and a subcooling expansion valve 38.

In the present embodiment, the compressor 21 is a device for compressing refrigerant, and a scroll type or other positive-displacement compressor capable of varying operating capacity by inverter control of the compressor motor 21*a* is used.

The first heat-exchange-switching mechanism 22 comprises, e.g., a four-way switching valve, and is a device capable of switching the flow channel of the refrigerant in the heat-source-side refrigerant circuit 12 so that the discharge side of the compressor 21 and the gas side of the first heat-source-side heat exchanger 24 are connected together (see the solid line of the first heat-exchange-switching mechanism 22 in FIG. 1) when the first heat-source-side heat exchanger 24 is caused to function as a refrigerant condenser (hereinafter referred to as "condensing-operation state"), and the intake side of the compressor 21 and the gas side of the first heat-source-side heat exchanger 24 are connected together (see the broken line of the first heat-exchange-switching mechanism 22 in FIG. 1) when the first heat-source-side heat exchanger 24 is caused to function as a refrigerant evaporator (hereinafter referred to as "evaporating-operation state").

The second heat-exchange-switching mechanism 23 comprises, e.g., a four-way switching valve, and is a device capable of switching the flow channel of the refrigerant in the heat-source-side refrigerant circuit 12 so that the discharge side of the compressor 21 and the gas side of the second heat-source-side heat exchanger 25 are connected together (see the solid line of the second heat-exchange-switching mechanism 23 in FIG. 1) when the second heat-source-side heat exchanger 25 is caused to function as a refrigerant condenser (hereinafter referred to as "condensing-operation state"), and the intake side of the compressor 21 and the gas side of the second heat-source-side heat exchanger 25 are connected together (see the broken line of the second heat-exchange-switching mechanism 23 in FIG. 1) when the second heat-source-side heat exchanger 25 is caused to function as a refrigerant evaporator (hereinafter referred to as "evaporating-operation state").

By changing the switching states of the first heat-exchange switching mechanism 22 and the second heat-exchange switching mechanism 23, the first heat-source-side heat exchanger 24 and the second heat-source-side heat exchanger 25 can each individually be switched between functioning as a refrigerant evaporator or a refrigerant condenser.

The first heat-source-side heat exchanger 24 is a device for performing heat exchange between the refrigerant and outdoor air, and is composed of, e.g., a fin-and-tube type heat exchanger having numerous heat-conducting tubes and fins. The gas side of the first heat-source-side heat exchanger 24 is connected to the first heat-exchange switching mechanism 22, and the liquid side of the first heat-source-side heat exchanger 24 is connected to a first heat-source-side flow-rate-regulating valve 26.

The second heat-source-side heat exchanger 25 is a device for performing heat exchange between the refrigerant and outdoor air, and is composed of, e.g., a fin-and-tube type heat exchanger having numerous heat-conducting tubes and fins. The gas side of the second heat-source-side heat exchanger 25 is connected to the second heat-exchange switching mechanism 23, and the liquid side of the second heat-source-side heat exchanger 25 is connected to a second heat-source-side flow-rate-regulating valve 27.

In the present embodiment, the first heat-source-side heat exchanger 24 and the second heat-source-side heat exchanger 25 are configured as an integrated heat-source-side heat exchanger.

Furthermore, the auxiliary heat-source-side heat exchanger 36 is a device for performing heat exchange between the refrigerant and outdoor air, and is composed of, e.g., a fin-and-tube type heat exchanger having numerous heat-conducting tubes and fins. The gas side of the auxiliary heat-source-side heat exchanger 36 is connected in a position nearer to a later-described high/low-pressure switching mechanism 30 than is the portion where the refrigerant discharged from the compressor 21 branches to the second heat-exchange-switching mechanism 23 side and the high/low-pressure switching mechanism 30 side. The liquid side of the auxiliary heat-source-side heat exchanger 36 is connected between a subcooling heat exchanger 44 and the receiver 28 midway along a receiver outlet tube 28*b*. An auxiliary expansion valve 37 capable of regulating the transiting amount of refrigerant is provided to the liquid side of the auxiliary heat-source-side heat exchanger 36. In the present embodiment, the auxiliary expansion valve 37 is composed of a motor-operated expansion valve in which the valve opening can be regulated.

In this case, the first heat-source-side heat exchanger 24, the second heat-source-side heat exchanger 25, and the auxiliary heat-source-side heat exchanger 36 are configured as an integrated heat-source-side heat exchanger.

The first heat-source-side heat exchanger 24 and the second heat-source-side heat exchanger 25 have different capacities, and in the present embodiment, the first heat-source-side heat exchanger 24 and the second heat-source-side heat exchanger 25 are designed to have a capacity ratio of 3:7. The positive displacement of the auxiliary heat-source-side heat exchanger 36 is designed to be less than that of other heat exchangers.

The heat source unit 2 has an outdoor fan 34 for drawing outdoor air into the unit and discharging the air from the unit after heat is exchanged, and is capable of causing heat to be exchanged between the outdoor air and the refrigerant flowing through the heat-source-side heat exchangers 24, 25. The outdoor fan 34 is driven by a speed-controllable outdoor fan motor 34*a*.

The first heat-source-side flow-rate-regulating valve 26 is a motor-operated expansion valve connected to the liquid side of the first heat-source-side heat exchanger 24 and in which the valve opening can be regulated in order to, inter alia, regulate the flow rate of refrigerant flowing through the first heat-source-side heat exchanger 24.

The second heat-source-side flow-rate-regulating valve 27 is a motor-operated expansion valve connected to the liquid side of the second heat-source-side heat exchanger 25 and in which the valve opening can be regulated in order to, inter alia, regulate the flow rate of refrigerant flowing through the second heat-source-side heat exchanger 25.

The auxiliary expansion valve 37 is a motor-operated expansion valve connected to the liquid side of the auxiliary heat-source-side heat exchanger 36 and in which the valve opening can be regulated in order to, inter alia, regulate the flow rate of refrigerant flowing through the auxiliary heat-source-side heat exchanger 36.

The receiver 28 is a container for temporarily collecting the refrigerant flowing between the heat-source-side heat exchangers 24, 25 and the usage-side refrigerant circuits 13*a*, 13*b*, 13*c*, 13*d*. A receiver inlet tube 28*a* is provided to a top part in the receiver 28, and a receiver outlet tube 28*b* is provided to a bottom part of the receiver 28. A receiver inlet open/close valve 28*c*, the opening and closing of which can be controlled, is provided to the receiver inlet tube 28*a*. The receiver inlet tube 28*a* and the receiver outlet tube 28*b* of the receiver 28 are connected between the liquid-side shutoff valve 31 and the heat-source-side heat exchangers 24, 25 via the bridge circuit 29.

A receiver gas-venting tube 41 is connected to the receiver 28. The receiver gas-venting tube 41 is provided so as to vent away refrigerant from the upper section of the receiver 28 separately from the receiver inlet tube 28*a*, and is connected to the upper section of the receiver 28 and the intake side of the compressor 21. A gas-vent-side flow-rate-regulating valve 42 as a gas-vent-side flow-rate-regulating mechanism is provided to the receiver gas-venting tube 41 in order to, inter alia, regulate the flow rate of refrigerant gas-vented away from the receiver 28. In the present embodiment, the gas-vent-side flow-rate-regulating valve 42 is a motor-operated expansion valve in which the valve opening can be regulated.

A receiver liquid-surface detection tube 43 for detecting whether the liquid surface in the receiver 28 has reached a predetermined height below a position in contact with the receiver gas-venting tube 41 is connected to the receiver 28. In the present embodiment, the receiver liquid-surface detection tube 43 is provided so that refrigerant from the portion in the intermediate vicinity in the height direction of the receiver 28 is vented away. The receiver liquid-surface detection tube 43 merges with the receiver gas-venting tube 41 via a capillary tube 43*a*. In the present embodiment, the receiver liquid-surface detection tube 43 is provided so as to merge with the portion further to the upstream side than where the gas-vent-side flow-rate-regulating valve 42 of the receiver gas-venting tube 41 is positioned. A double-tube heat exchanger 35 for heating refrigerant flowing through the receiver gas-venting tube 41 is provided further to the downstream side that the position where the receiver liquid-surface detection tube 43 merges. In the present embodiment, the double-tube heat exchanger 35 is a heat exchanger for heating refrigerant flowing through the receiver gas-venting tube 41 using as a heat source the refrigerant that is discharged from the compressor 21, flows toward the high/low-pressure switching mechanism 30 side, and thereafter flows toward the auxiliary heat-source-side heat exchanger 36; the double-tube heat exchanger comprising, e.g., a piped heat exchanger configured by bringing the receiver gas-venting tube 41 and the refrigerant piping extended toward the auxiliary heat-source-side heat exchanger 36 into contact with each other. A gas-vent-side temperature sensor 75 for detecting the temperature of refrigerant of the receiver gas-venting tube 41 that has passed through the double-tube heat exchanger 35 is provided to the outlet of the double-tube heat exchanger 35.

The subcooling heat exchanger 44 is provided partway along the receiver outlet tube 28*b* for allowing liquid refrigerant accumulated in the receiver 28 to flow. The subcooling circuit branches from between the receiver 28 and the subcooling heat exchanger 44 and is connected to the intake side of the compressor 21. In the subcooling circuit, the subcooling expansion valve 38 is provided between the receiver outlet tube 28*b* and the subcooling heat exchanger 44 and is capable of regulating the degree of subcooling of the refrigerant that passes through the subcooling heat exchanger 44 and flows through the receiver outlet tube 28*b*. A subcooling sensor 39 capable of detecting the temperature of passing refrigerant is provided near the outlet of the subcooling heat exchanger 44 in the subcooling circuit, and the valve opening of the subcooling expansion valve 38 is controlled in accordance therewith.

The bridge circuit 29 is a circuit having a function for causing refrigerant to flow into the receiver 28 through the receiver inlet tube 28*a* and causing refrigerant to flow out from the receiver 28 through the receiver outlet tube 28*b* when refrigerant flows toward the liquid-side shutoff valve 31 from the heat-source-side heat exchangers 24, 25, as well as when refrigerant flows toward the heat-source-side heat exchangers 24, 25 from the liquid-side shutoff valve 31. The bridge circuit 29 has four non-return valves 29*a*, 29*b*, 29*c*, 29*d*. An inlet non-return valve 29*a* is a non-return valve for allowing refrigerant to flow only from the heat-source-side heat exchangers 24, 25 to the receiver inlet tube 28*a*. An inlet non-return valve 29*b* is a non-return valve for allowing refrigerant to flow only from the liquid-side shutoff valve 31 to the receiver inlet tube 28*a*. Specifically, the inlet non-return valves 29*a*, 29*b* have a function for causing refrigerant to flow from the heat-source-side heat exchangers 24, 25 or the liquid-side shutoff valve 31 to the receiver inlet tube 28*a*. An outlet non-return valve 29*c* is a non-return valve for allowing refrigerant to flow only from the receiver outlet tube 28*b* to the liquid-side shutoff valve 31. An outlet non-return valve 29*d* is a non-return valve for allowing refrigerant to flow only from the receiver outlet tube 28*b* to the heat-source-side heat exchangers 24, 25. Specifically, the outlet non-return valves 29*c*, 29*d* have a function for causing refrigerant to flow from the receiver outlet tube 28*b* to the heat-source-side heat exchangers 24, 25 or the liquid-side shutoff valve 31.

The high/low pressure switching mechanism 30 comprises a four-way switching valve, for example, and is a device capable of switching the flow path of refrigerant in the heat-source-side refrigerant circuit 12 so that the high/low-pressure-gas-side shutoff valve 32 and the discharge side of the compressor 21 are connected (as indicated by broken lines in the high/low pressure switching mechanism 30 in FIG. 1) when high-pressure gas refrigerant discharged from the compressor 21 is sent to the usage-side refrigerant circuits 13*a*, 13*b*, 13*c*, 13*d* (referred to below as a "mainly-condensation-load operation state"), and the high/low-pressure-gas-side shutoff valve 32 and the intake side of the compressor 21 are connected (as indicated by solid lines in the high/low pressure switching mechanism 30 in FIG. 1) when high-pressure gas refrigerant discharged from the compressor 21 is not sent to the usage-side refrigerant circuits 13*a*, 13*b*, 13*c*, 13*d* (referred to below as a "mainly-evaporation-load operation state").

The liquid-side shutoff valve 31, the high/low-pressure-gas-side shutoff valve 32, and the low-pressure-gas-side shutoff valve 33 are valves provided to a port for connection with an external device/piping (specifically, the refrigerant communicating tubes 7, 8, 9). The liquid-side shutoff valve 31 is connected to the receiver inlet tube 28*a* or the receiver outlet tube 28*b* via the bridge circuit 29. The high/low-pressure-gas-side shutoff valve 32 is connected to the high/low pressure switching mechanism 30. The low-pressure-gas-side shutoff valve 33 is connected to the intake side of the compressor 21.

In addition, various sensors are provided to the heat source unit 2.

Specifically, there are provided a subcooling sensor 39 for detecting the temperature of the refrigerant near the outlet of the subcooling heat exchanger 44 in the subcooling circuit, an intake pressure sensor 71 for detecting the pressure of refrigerant on the intake side of the compressor 21, a discharge temperature sensor 73 for detecting the temperature of refrigerant on the discharge side of the compressor 21, a gas-vent-side temperature sensor 75 for detecting the temperature of refrigerant flowing through the receiver gas-venting tube 41, a first gas-liquid temperature sensor 81 for detecting the temperature of refrigerant flowing through the liquid side (between the first heat-source-side heat exchanger 24 and the first heat-source-side flow-rate-regulating valve 26) of the first heat-source-side heat exchanger 24, a second gas-liquid temperature sensor 82 for detecting the temperature of refrigerant flowing through the liquid side (between the second heat-source-side heat exchanger 25 and the second heat-source-side flow-rate-regulating valve 27) of the second heat-source-side heat exchanger 25, a first gas-side temperature sensor 91 for detecting the temperature of refrigerant flowing through the gas side (between the first heat-source-side heat exchanger 24 and the first heat-exchange-switching mechanism 22) of the first heat-source-side heat exchanger 24, and a second gas-side temperature sensor 92 for detecting the temperature of refrigerant flowing through the gas side (between the second heat-source-side heat exchanger 25 and the second heat-exchange-switching mechanism 23) of the second heat-source-side heat exchanger 25. In the present embodiment, the gas-vent-side temperature sensor 75 is provided to the receiver gas-venting tube 41 so as to detect the temperature of refrigerant in the outlet of the double-tube heat exchanger 35.

The heat source unit 2 has the heat-source-side controller 20 for controlling the operation of the components 21*a*, 22, 23, 26, 27, 28*c*, 30, 34*a*, 41 constituting the heat source unit 2. The heat-source-side controller 20 has a microcomputer or memory provided for controlling the heat source unit 2, and is able to exchange control signals and the like with usage-side controllers 50*a*, 50*b*, 50*c*, 50*d* of the usage units 3*a*, 3*b*, 3*c*, 3*d*.

(1-3) Connecting Units

The connecting units 4*a*, 4*b*, 4*c*, 4*d* are provided together with the usage units 3*a*, 3*b*, 3*c*, 3*d* inside a building or the like. The connecting units 4*a*, 4*b*, 4*c*, 4*d* are interposed between usage units 3, 4, 5 and the heat source unit 2 together with refrigerant communicating tubes 7, 8, 9, and constitute a portion of the refrigerant circuit 10.

The configuration of the connecting units 4*a*, 4*b*, 4*c*, 4*d* will next be described.

The connecting unit 4*a* and the connecting units 4*b*, 4*c*, 4*d* have the same configuration. Therefore, only the configuration of the connecting unit 4*a* will be described. To refer to the configuration of the connecting units 4*b*, 4*c*, 4*d*, the subscripts "b," "c," and "d" are added instead of "a" to the reference signs for indicating the components of the connecting unit 4*a*, and the components of the connecting units 4*b*, 4*c*, 4*d* will not be described.

The connecting unit 4*a* primarily constitutes a portion of the refrigerant circuit 10 and has a connection-side refrigerant circuit 14*a* (connection-side refrigerant circuit 14*b*, 14*c*, 14*d* in the connecting units 4*b*, 4*c*, 4*d*, respectively). The connection-side refrigerant circuit 14*a* has primarily a liquid connecting tube 61*a* and a gas connecting tube 62*a*.

The liquid connecting tube 61*a* connects the liquid refrigerant communicating tube 7 and the usage-side flow-rate-regulating valve 51*a* of the usage-side refrigerant circuit 13*a*.

The gas connecting tube 62*a* has a high-pressure gas connecting tube 63*a* connected to a high/low-pressure gas refrigerant communicating tube 8, a low-pressure gas connecting tube 64*a* connected to a low-pressure gas refrigerant communicating tube 9, and a merging gas connecting tube 65*a* for merging the high-pressure gas connecting tube 63*a* and the low-pressure gas connecting tube 64*a*. The merging gas connecting tube 65*a* is connected to the gas side of the usage-side heat exchanger 52*a* of the usage-side refrigerant circuit 13*a*. A high-pressure gas open/close valve 66*a*, the opening and closing of which can be controlled, is provided to the high-pressure gas connecting tube 63*a*, and a low-pressure gas open/close valve 67*a*, the opening and closing of which can be controlled, is provided to the low-pressure gas connecting tube 64*a*.

During air-cooling operation by the usage unit 3*a*, the connecting unit 4*a* can function so that the low-pressure gas open/close valve 67*a* is placed in an open state, refrigerant flowing into the liquid connecting tube 61*a* through the liquid refrigerant communicating tube 7 is sent to the usage-side heat exchanger 52*a* through the usage-side flow-rate-regulating valve 51*a* of the usage-side refrigerant circuit 13*a*, and refrigerant evaporated by heat exchange with indoor air in the usage-side heat exchanger 52*a* is returned to the low-pressure gas refrigerant communicating tube 9 through the merging gas connecting tube 65*a* and the low-pressure gas connecting tube 64*a*.

During air-warming operation by the usage unit 3*a*, the connecting unit 4*a* can function so that the low-pressure gas open/close valve 67*a* is closed and the high-pressure gas open/close valve 66*a* is placed in an open state, refrigerant flowing into the high-pressure gas connecting tube 63*a* and the merging gas connecting tube 65*a* through the high/low-pressure gas refrigerant communicating tube 8 is sent to the usage-side heat exchanger 52*a* of the usage-side refrigerant circuit 13*a*, and refrigerant condensed by heat exchange with indoor air in the usage-side heat exchanger 52*a* is returned to the liquid refrigerant communicating tube 7 through the usage-side flow-rate-regulating valve 51*a* and the liquid connecting tube 61*a*.

This function is performed not only by the connecting unit 4*a*, but also by the connecting units 4*b*, 4*c*, 4*d* in the same manner, and the usage-side heat exchangers 52*a*, 52*b*, 52*c*, 52*d* can therefore each individually be switched between functioning as refrigerant evaporators or refrigerant condensers by the connecting units 4*a*, 4*b*, 4*c*, 4*d*.

The connecting unit 4*a* has a connection-side controller 60*a* for controlling the operation of the components 66*a*, 67*a* constituting the connecting unit 4*a*. The connection-side controller 60*a* has a microcomputer and/or memory provided to control the connecting unit 4*a*, and is configured so as to be capable of exchanging control signals and the like with the usage-side controller 50*a* of the usage unit 3*a*.

As described above, the usage-side refrigerant circuits 13*a*, 13*b*, 13*c*, 13*d*, the heat-source-side refrigerant circuit 12, the refrigerant communicating tubes 7, 8, 9, and the connection-side refrigerant circuits 14*a*, 14*b*, 14*c*, 14*d* are connected together to configure the refrigerant circuit 10 of the refrigerating apparatus 1. In the refrigerating apparatus 1, the refrigerating apparatus is configured having a refrigerant circuit that includes the compressor 21, the heat-source-side heat exchangers 24, 25, the receiver 28, the usage-side heat exchangers 52*a*, 52*b*, 52*c*, 52*d*, and the receiver gas-venting tube 41 for connecting the upper portion of the receiver 28 and the intake side of the compressor 21.

(2) Operation of Refrigeration Apparatus

The operation of the refrigerating apparatus 1 will next be described.

The refrigerating cycle operation of the refrigerating apparatus 1 includes air-cooling operation, air-warming operation, simultaneous cooling/warming operation (mainly evaporation load), and simultaneous cooling/warming operation (mainly condensation load).

In the present embodiment, the air-cooling operation involves only usage units that carry out an air-cooling operation (i.e., operation in which the usage-side heat exchangers function as refrigerant evaporators) and causes the heat-source-side heat exchangers 24, 25 to function as refrigerant condensers in relation to the evaporation load of the usage units overall.

The air-warming operation involves only usage units that carry out an air-warming operation (i.e., operation in which the usage-side heat exchangers function as refrigerant condensers) and causes the heat-source-side heat exchangers 24, 25 to function as refrigerant evaporators in relation to the condensation load of the usages units overall.

The simultaneous air-cooling and air-warming operation (mainly evaporation load) involves mixture of usage units for carrying out an air-cooling operation (i.e., operation in which the usage-side heat exchangers function as refrigerant evaporators) and usage units for carrying out an air-warming operation (i.e., operation in which the usage-side heat exchangers function as refrigerant condensers), and causes the heat-source-side heat exchangers 24, 25 to function a refrigerant condensers in relation to the evaporation load of the usage units overall when the heat load of the usage units overall is mainly an evaporation load.

The simultaneous air-cooling and air-warming operation (mainly the condensation load) involves mixture of usage units for carrying out an air-cooling operation (i.e., operation in which the usage-side heat exchangers function as refrigerant evaporators) and usage units for carrying out an air-warming operation (i.e., operation in which the usage-side heat exchangers function as refrigerant condensers), and causes the heat-source-side heat exchangers 24, 25 to function as refrigerant evaporators in relation to the condensation load of the usage units overall when the heat load of the usage units overall is mainly the condensation load.

The actuation of the refrigerating apparatus 1 including these refrigerating cycle operations is carried out by the above-described controllers 20, 50, 50*a*, 50*b*, 50*c*, 50*d*, 60*a*, 60*b*, 60*c*, 60*d*.

(2-1) Air-Cooling Operation

Figure 3:
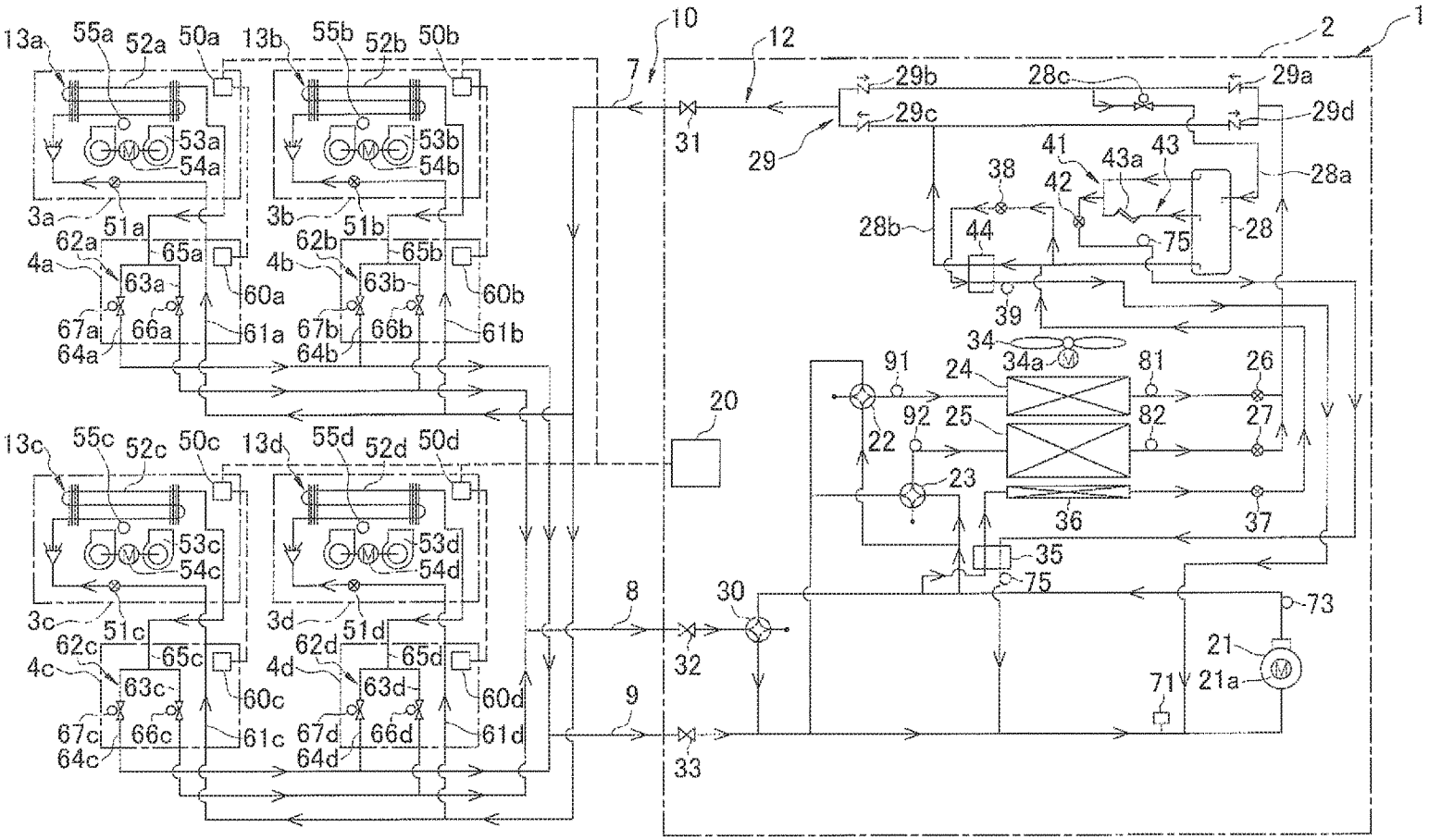
FIG. 3 is a view illustrating operation (refrigerant flow) in air-cooling operation.

During air-cooling operation, e.g., when all of the usage units 3*a*, 3*b*, 3*c*, 3*d* perform an air-cooling operation (i.e., operation in which all of the usage-side heat exchangers 52*a*, 52*b*, 52*c*, 52*d* function as refrigerant evaporators), and the heat-source-side heat exchangers 24, 25 function as refrigerant condensers, the refrigerant circuit 10 of the refrigerating apparatus 1 is configured in the manner shown in FIG. 3 (the arrows affixed to the refrigerant circuit 10 of FIG. 3 indicate the flow of refrigerant).

Specifically, in the heat source unit 2, the first heat-exchange-switching mechanism 22 is switched to a condensing operation state (the state indicated by the solid line in the first heat-exchange-switching mechanism 22 of FIG. 3) and the second heat-exchange-switching mechanism 23 is switched to a condensing operation state (the state indicated by the solid line in the second heat-exchange-switching mechanism 23 of FIG. 3), whereby the heat-source-side heat exchangers 24, 25 are caused to function as refrigerant condensers. The high/low pressure switching mechanism 30 is also switched to a mainly-evaporation-load operation state (state indicated by solid lines in the high/low pressure switching mechanism 30 in FIG. 3). The valve openings of the first heat-source-side flow-rate-regulating valve 26 and the second heat-source-side flow-rate-regulating valve 27 are regulated, and the receiver inlet open/close valve 28*c* is set in an on-state. Regulating the valve opening of the auxiliary expansion valve 37 makes it possible to regulate the flow rate of refrigerant in the auxiliary heat-source-side heat exchanger 36. The valve opening of the gas-vent-side flow-rate-regulating valve 42 as a gas-vent-side flow-rate-regulating mechanism is regulated on the basis of the value detected by the gas-vent-side temperature sensor 75 so that wet refrigerant is inhibited from being taken into the compressor 21, thereby making it possible to regulate the amount of heat exchange in the double-tube heat exchanger 35, and to regulate the amount of gas refrigerant vented from the receiver 28 to the intake side of the compressor 21 by way of the receiver gas-venting tube 41. In addition, regulating the valve opening of the subcooling expansion valve 38 on the basis of the temperature detected by the subcooling sensor 39 makes it possible to regulate the degree of subcooling of the refrigerant flowing through the receiver outlet tube 28*b* at the outlet of the subcooling heat exchanger 44. In the connecting units 4*a*, 4*b*, 4*c*, 4*d*, the high-pressure gas open/close valves 66*a*, 66*b*, 66*c*, 66*d* and the low-pressure gas open/close valves 67*a*, 67*b*, 67*c*, 67*d* are placed in the open state, whereby all of the usage-side heat exchangers 52*a*, 52*b*, 52*c*, 52*d* of the usage units 3*a*, 3*b*, 3*c*, 3*d* are caused to function as refrigerant evaporators, and all of the usage-side heat exchangers 52*a*, 52*b*, 52*c*, 52*d* of the usage units 3*a*, 3*b*, 3*c*, 3*d* and the intake side of the compressor 21 of the heat source unit 2 are connected via the high/low-pressure gas refrigerant communicating tube 8 and the low-pressure gas refrigerant communicating tube 9. In the usage units 3*a*, 3*b*, 3*c*, 3*d*, the valve openings of the usage-side flow-rate-regulating valves 51*a*, 51*b*, 51*c*, 51*d* are regulated by the heat-source-side controller 20 so that, e.g., the degree of superheating of the refrigerant flowing through the outlets of the usage-side heat exchangers 52*a*, 52*b*, 52*c*, 52*d* reaches a predetermined value.

In such a refrigerant circuit 10, a portion of the high-pressure gas refrigerant compressed and discharged by the compressor 21 is sent to the heat-source-side heat exchangers 24, 25 by way of the heat-exchange switching mechanisms 22, 23, and the other portion is sent to the auxiliary heat-source-side heat exchanger 36 by way of the double-tube heat exchanger 35. The high-pressure gas refrigerant sent to the heat-source-side heat exchangers 24, 25 is then condensed in the heat-source-side heat exchangers 24, 25 by heat exchange with outdoor air supplied as a heat source by the outdoor fan 34. The flow rate of the refrigerant condensed in the heat-source-side heat exchangers 24, 25 is regulated in the first heat-source-side flow-rate-regulating valve 26 and the second heat-source-side flow-rate-regulating valve 27. The refrigerant is thereafter merged and sent to the receiver 28 by way of the inlet non-return valve 29*a* and the receiver inlet open/close valve 28*c*. In the present embodiment, the valve opening of the first heat-source-side flow-rate-regulating valve 26 is controlled by the heat-source-side controller 20 so that the degree of subcooling (the degree of subcooling ascertained from the first gas-liquid temperature sensor 81) of refrigerant flowing through the outlet of the first heat-source-side heat exchanger 24 is brought to a predetermined value, and the valve opening of the second heat-source-side flow-rate-regulating valve 27 is controlled so that the degree of subcooling (the degree of subcooling ascertained from the second gas-liquid temperature sensor 82) of refrigerant flowing through the outlet of the second heat-source-side heat exchanger 25 is brought to a predetermined value. The refrigerant sent to the receiver 28 is temporarily accumulated in the receiver 28 and subjected to gas-liquid separation. The gas refrigerant thereafter undergoes heat exchange in the double-tube heat exchanger 35 by way of the receiver gas-venting tube 41 and is then vented away to the intake side of the compressor 21. The liquid refrigerant passes through the receiver outlet tube 28*b* and is sent to the liquid refrigerant communicating tube 7 by way of the outlet non-return valve 29*c* and the liquid-side shut-off valve 31. The refrigerant condensed in the double-tube heat exchanger 35 and the auxiliary heat-source-side heat exchanger 36 is merged partway along the receiver outlet tube 28*b*.

The refrigerant sent to the liquid refrigerant communicating tube 7 is branched into four streams and sent to the liquid connecting tubes 61*a*, 61*b*, 61*c*, 61*d* of the connecting units 4*a*, 4*b*, 4*c*, 4*d*. The refrigerant sent to the liquid connecting tubes 61*a*, 61*b*, 61*c*, 61*d* is then sent to the usage-side flow-rate-regulating valves 51*a*, 51*b*, 51*c*, 51*d* of the usage units 3*a*, 3*b*, 3*c*, 3*d*.

After the flow rate of the refrigerant sent to the usage-side flow-rate-regulating valves 51*a*, 51*b*, 51*c*, 51*d* is regulated in the usage-side flow-rate-regulating valves 51*a*, 51*b*, 51*c*, 51*d*, the refrigerant is evaporated in the usage-side heat exchangers 52*a*, 52*b*, 52*c*, 52*d* by heat exchange with indoor air supplied by the indoor fans 53*a*, 53*b*, 53*c*, 53*d*, and becomes low-pressure gas refrigerant. Meanwhile, the indoor air is cooled and supplied indoors, and air-cooling operation by the usage units 3*a*, 3*b*, 3*c*, 3*d* is performed. The low-pressure gas refrigerant is then sent to the merging gas connecting tubes 65*a*, 65*b*, 65*c*, 65*d* of the connecting units 4*a*, 4*b*, 4*c*, 4*d*.

The low-pressure gas refrigerant sent to the merging gas connecting tubes 65*a*, 65*b*, 65*c*, 65*d* is then sent to the high/low-pressure gas refrigerant communicating tube 8 through the high-pressure gas open/close valves 66*a*, 66*b*, 66*c*, 66*d* and the high-pressure gas connecting tubes 63*a*, 63*b*, 63*c*, 63*d* and merged, and also sent to the low-pressure gas refrigerant communicating tube 9 through the low-pressure gas open/close valves 67*a*, 67*b*, 67*c*, 67*d* and the low-pressure gas connecting tubes 64*a*, 64*b*, 64*c*, 64*d* and merged.

The low-pressure gas refrigerant sent to the gas refrigerant communicating tubes 8, 9 is then returned to the intake side of the compressor 21 through the gas-side shutoff valves 32, 33 and the high/low pressure switching mechanism 30.

Operation is carried out in this manner in an air-cooling operation.

Although a detailed description is omitted, a target evaporation temperature is established in air-cooling operation so that the compressor 21 is able to process the air-cooling load in all the usage-side heat exchangers 52*a*, 52*b*, 52*c*, 52*d* functioning as refrigerant evaporators, and the frequency is controlled so that the target evaporation temperature can be achieved.

When some of the usage units 3*a*, 3*b*, 3*c*, 3*d* perform air-cooling operation (i.e., an operation in which some of the usage-side heat exchangers 52*a*, 52*b*, 52*c*, 52*d* function as refrigerant evaporators) and the evaporation load of the usage-side heat exchangers 52*a*, 52*b*, 52*c*, 52*d* overall is reduced, operation is carried out for causing only one of the heat-source-side heat exchangers 24, 25 (e.g., the first heat-source-side heat exchanger 24) to function as a refrigerant condenser.

(2-2) Air-Warming Operation

Figure 4:
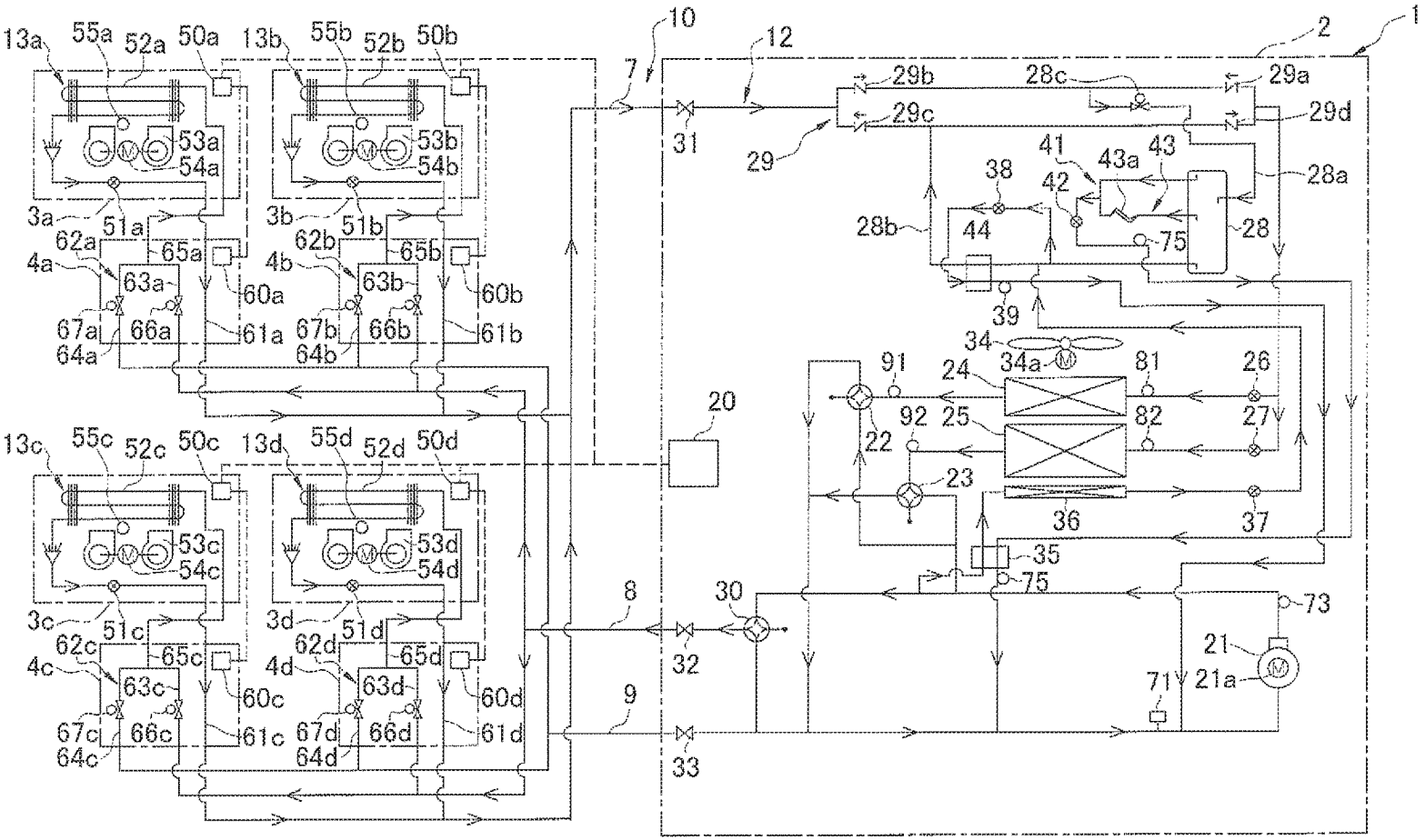
FIG. 4 is a view illustrating operation (refrigerant flow) in air-warming operation.

During the air-warming operation, e.g., when all of the usage units 3*a*, 3*b*, 3*c*, 3*d* perform the air-warming operation (i.e., operation in which all of the usage-side heat exchangers 52*a*, 52*b*, 52*c*, 52*d* function as refrigerant condensers), and the heat-source-side heat exchangers 24, 25 function as refrigerant evaporators, the refrigerant circuit 10 of the refrigerating apparatus 1 is configured in the manner shown in FIG. 4 (See: the arrows affixed to the refrigerant circuit 10 of FIG. 4 for the flow of refrigerant).

Specifically, in the heat source unit 2, the first heat-exchange switching mechanism 22 is switched to an evaporating operation state (state indicated by broken lines in the first heat-exchange switching mechanism 22 in FIG. 4) and the second heat-exchange switching mechanism 23 is switched to an evaporating operation state (state indicated by broken lines in the second heat-exchange switching mechanism 23 in FIG. 4), whereby the heat-source-side heat exchangers 24, 25 are caused to function as refrigerant evaporators. The high/low pressure switching mechanism 30 is also switched to a mainly-condensation-load operation state (state indicated by broken lines in the high/low pressure switching mechanism 30 in FIG. 4). The valve openings of the first heat-source-side flow-rate-regulating valve 26 and the second heat-source-side flow-rate-regulating valve 27 are also regulated, and the receiver inlet open/close valve 28*c* is set in the open-state. Furthermore, regulating the valve opening of the auxiliary expansion valve 37 makes it possible to regulate the flow rate of refrigerant in the auxiliary heat-source-side heat exchanger 36. The valve opening of the gas-vent-side flow-rate-regulating valve 42 as a gas-vent-side flow-rate-regulating mechanism is also regulated on the basis of the value detected by the gas-vent-side temperature sensor 75 so that wet refrigerant is inhibited from being taken into the compressor 21, thereby making it possible to regulate the amount of heat exchange in the double-tube heat exchanger 35, and to regulate the amount of gas refrigerant vented from the receiver 28 to the intake side of the compressor 21 by way of the receiver gas-venting tube 41. In addition, regulating the valve opening of the subcooling expansion valve 38 on the basis of the temperature detected by the subcooling sensor 39 makes it possible to regulate the degree of subcooling of the refrigerant flowing through the receiver outlet tube 28*b* at the outlet of the subcooling heat exchanger 44. In the connecting units 4*a*, 4*b*, 4*c*, 4*d*, the high-pressure gas open/close valves 66*a*, 66*b*, 66*c*, 66*d* are placed in the open state and the low-pressure gas open/close valves 67*a*, 67*b*, 67*c*, 67*d* are placed in the closed state, whereby all of the usage-side heat exchangers 52*a*, 52*b*, 52*c*, 52*d* of the usage units 3*a*, 3*b*, 3*c*, 3*d* are caused to function as refrigerant condensers, and all of the usage-side heat exchangers 52*a*, 52*b*, 52*c*, 52*d* of the usage units 3*a*, 3*b*, 3*c*, 3*d* and the discharge side of the compressor 21 of the heat source unit 2 are connected via the high/low-pressure gas refrigerant communicating tube 8. In the usage units 3*a*, 3*b*, 3*c*, 3*d*, the valve openings of the usage-side flow-rate-regulating valves 51*a*, 51*b*, 51*c*, 51*d* are regulated by the heat-source-side controller 20 so that, e.g., the degree of subcooling of the refrigerant flowing through the outlets of the usage-side heat exchangers 52*a*, 52*b*, 52*c*, 52*d* reaches a predetermined value.

In such a refrigerant circuit 10, a portion of the high-pressure gas refrigerant compressed and discharged by the compressor 21 is sent to the high/low-pressure gas-refrigerant communicating tube 8 by way of the high/low-pressure switching mechanism 30 and the high/low-pressure gas-side shut-off valve 32, and the other portion is sent to the auxiliary heat-source-side heat exchanger 36 by way of the double-tube heat exchanger 35.

The high-pressure gas refrigerant sent to the high/low-pressure gas refrigerant communicating tube 8 is branched into four streams and sent to the high-pressure gas connecting tubes 63*a*, 63*b*, 63*c*, 63*d* of the connecting units 4*a*, 4*b*, 4*c*, 4*d*. The high-pressure gas refrigerant sent to the high-pressure gas connecting tubes 63*a*, 63*b*, 63*c*, 63*d* is then sent to the usage-side heat exchangers 52*a*, 52*b*, 52*c*, 52*d* of the usage units 3*a*, 3*b*, 3*c*, 3*d* through the high-pressure gas open/close valves 66*a*, 66*b*, 66*c*, 66*d* and the merging gas connecting tubes 65*a*, 65*b*, 65*c*, 65*d*.

The high-pressure gas refrigerant sent to the usage-side heat exchangers 52*a*, 52*b*, 52*c*, 52*d* is then condensed in the usage-side heat exchangers 52*a*, 52*b*, 52*c*, 52*d* by heat exchange with indoor air supplied by the indoor fans 53*a*, 53*b*, 53*c*, 53*d*. Meanwhile, the indoor air is heated and supplied indoors, and the air-warming operation by the usage units 3*a*, 3*b*, 3*c*, 3*d* is performed. After the flow rate of the refrigerant condensed in the usage-side heat exchangers 52*a*, 52*b*, 52*c*, 52*d* is regulated in the usage-side flow-rate-regulating valves 51*a*, 51*b*, 51*c*, 51*d*, the refrigerant is sent to the liquid connecting tubes 61*a*, 61*b*, 61*c*, 61*d* of the connecting units 4*a*, 4*b*, 4*c*, 4*d*.

The refrigerant sent to the liquid connecting tubes 61*a*, 61*b*, 61*c*, 61*d* is then sent to the liquid refrigerant communicating tube 7 and merged.

The refrigerant sent to the liquid refrigerant communicating tube 7 is then sent to the receiver 28 through the liquid-side shutoff valve 31, the inlet non-return valve 29*b*, and the receiver inlet open/close valve 28*c*. The refrigerant sent to the receiver 28 is temporarily accumulated in the receiver 28 and subjected to gas-liquid separation. The gas refrigerant thereafter undergoes heat exchange in the double-tube heat exchanger 35 by way of the receiver gas-venting tube 41 and is then vented away to the intake side of the compressor 21. The liquid refrigerant passes through the receiver outlet tube 28*b* and is sent to both the first heat-source-side flow-rate-regulating valve 26 and the second heat-source-side flow-rate-regulating valve 27 by way of the outlet non-return valve 29*d*.

The refrigerant condensed in the double-tube heat exchanger 35 and the auxiliary heat-source-side heat exchanger 36 is merged partway along the receiver outlet tube 28*b*.

The flow rate of the refrigerant sent to the first heat-source-side flow-rate-regulating valve 26 and the second heat-source-side flow-rate-regulating valve 27 is regulated by the first heat-source-side flow-rate-regulating valve 26 and the second heat-source-side flow-rate-regulating valve 27. The refrigerant is thereafter evaporated in the heat-source-side heat exchangers 24, 25 by heat exchange with outdoor air fed by the outdoor fan 34 to become low-pressure gas refrigerant, and is sent to the heat-exchange switching mechanisms 22, 23. The low-pressure gas refrigerant sent to the heat-exchange switching mechanisms 22, 23 is merged and returned to the intake side of the compressor 21.

Operation is carried out in this manner in the air-warming operation.

Although a detailed description is described later, a target condensation temperature is established in the air-warming operation so that the compressor 21 is able to process the air-warming load in all the usage-side heat exchangers 52*a*, 52*b*, 52*c*, 52*d* functioning as refrigerant condensers, and the frequency is controlled so that the target condensation temperature can be achieved.

When some of the usage units 3*a*, 3*b*, 3*c*, 3*d* perform the air-warming operation (i.e., operation in which some of the usage-side heat exchangers 52*a*, 52*b*, 52*c*, 52*d* function as refrigerant condensers) and the condensation load of the usage-side heat exchangers 52*a*, 52*b*, 52*c*, 52*d* overall is reduced, operation is carried out for causing only one of the heat-source-side heat exchangers 24, 25 (e.g., first heat-source-side heat exchanger 24) to function as a refrigerant evaporator.

(2-3) Simultaneous Air-Cooling and Air-Warming Operations (Mainly Evaporation Load)

Figure 5:
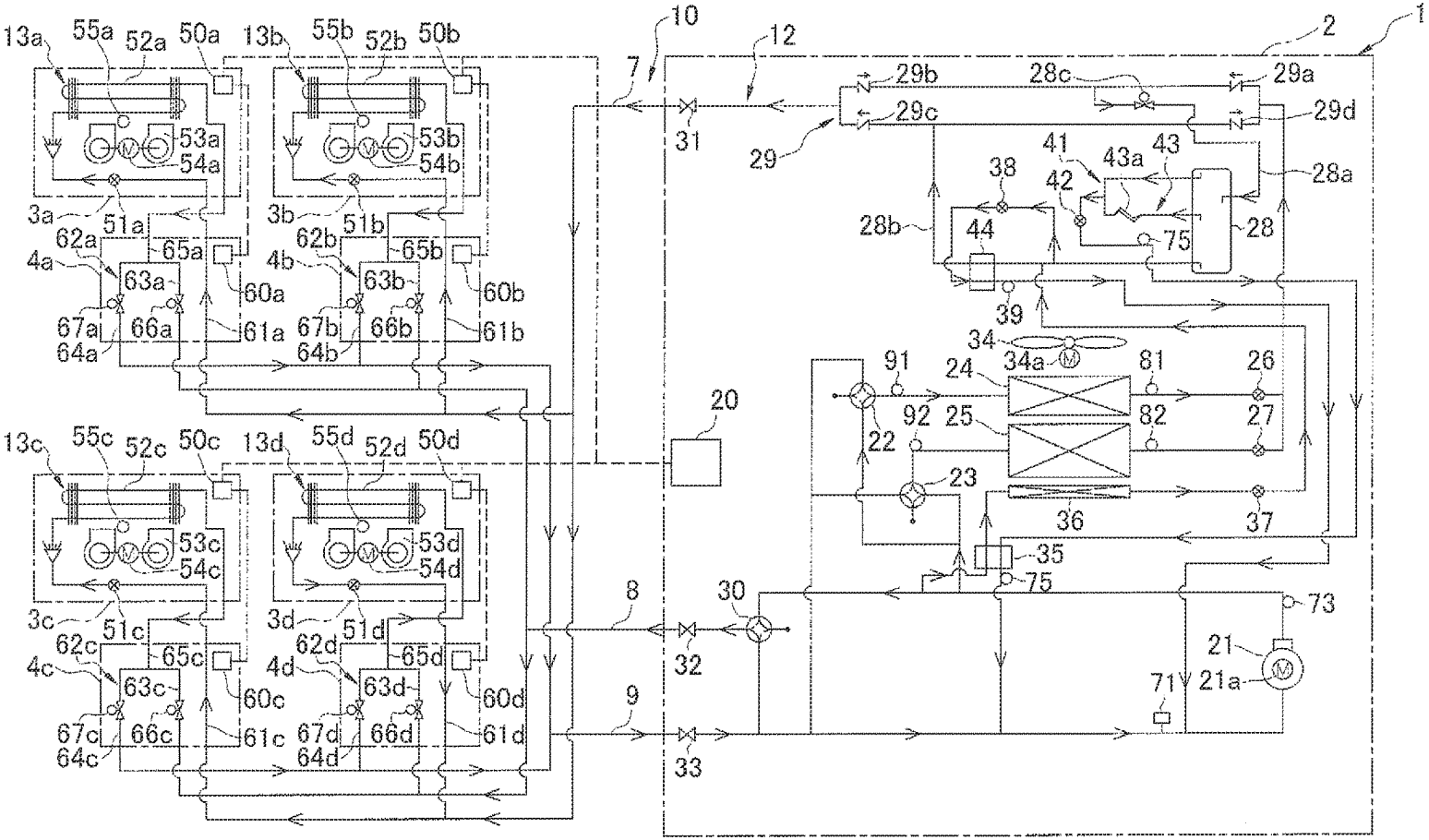
FIG. 5 is a view illustrating operation (refrigerant flow) in simultaneous cooling/warming operation (mainly evaporation load)

During simultaneous air-cooling and air-warming operation (mainly evaporation load), e.g., when the usage units 3*a*, 3*b*, 3*c* perform an air-cooling operations and the usage unit 3*d* performs an air-warming operation (i.e., the usage-side heat exchangers 52*a*, 52*b*, 52*c* function as refrigerant evaporators and the usage-side heat exchanger 52*d* functions as a refrigerant condenser), and the first heat-source-side heat exchanger 24 functions as a refrigerant condenser, the refrigerant circuit 10 of the refrigerating apparatus 1 is configured in the manner shown in FIG. 5 (See: the arrows affixed to the refrigerant circuit 10 of FIG. 5 for the flow of refrigerant).

Specifically, in the heat source unit 2, the first heat-exchange switching mechanism 22 is switched to the condensing operation state (state indicated by solid lines in the first heat-exchange switching mechanism 22 in FIG. 5), whereby only the first heat-source-side heat exchanger 24 is caused to function as a refrigerant condenser. The high/low pressure switching mechanism 30 is also switched to a mainly-condensation-load operation state (state indicated by broken lines in the high/low pressure switching mechanism 30 in FIG. 5). The opening degree of the first heat-source-side flow-rate-regulating valve 26 is also regulated, the second heat-source-side flow-rate-regulating valve 27 is closed, and the receiver inlet open/close valve 28*c* is open. Regulating the valve opening of the auxiliary expansion valve 37 makes it possible to regulate the flow rate of refrigerant in the auxiliary heat-source-side heat exchanger 36. The valve opening of the gas-vent-side flow-rate-regulating valve 42 as a gas-vent-side flow-rate-regulating mechanism is regulated on the basis of the value detected by the gas-vent-side temperature sensor 75 so that wet refrigerant is inhibited from being taken into the compressor 21, thereby making it possible to regulate the amount of heat exchange in the double-tube heat exchanger 35, and to regulate the amount of gas refrigerant vented from the receiver 28 to the intake side of the compressor 21 by way of the receiver gas-venting tube 41. In addition, regulating the valve opening of the subcooling expansion valve 38 on the basis of the temperature detected by the subcooling sensor 39 makes it possible to regulate the degree of subcooling of the refrigerant flowing through the receiver outlet tube 28*b* at the outlet of the subcooling heat exchanger 44. In the connecting units 4*a*, 4*b*, 4*c*, 4*d*, the high-pressure gas open/close valve 66*d* and the low-pressure gas open/ close valves 67*a*, 67*b*, 67*c* are placed in the open state and the high-pressure gas open/close valves 66*a*, 66*b*, 66*c* and the low-pressure gas open/close valve 67*d* are placed in the closed state, whereby the usage-side heat exchangers 52*a*, 52*b*, 52*c* of the usage units 3*a*, 3*b*, 3*c* are caused to function as refrigerant evaporators, the usage-side heat exchanger 52*d* of the usage unit 3*d* is caused to function as a refrigerant condenser, the usage-side heat exchangers 52*a*, 52*b*, 52*c* of the usage units 3*a*, 3*b*, 3*c* and the intake side of the compressor 21 of the heat source unit 2 are connected via the low-pressure gas refrigerant communicating tube 9, and the usage-side heat exchanger 52*d* of the usage unit 3*d* and the discharge side of the compressor 21 of the heat source unit 2 are connected via the high/low-pressure gas refrigerant communicating tube 8. In the usage units 3*a*, 3*b*, 3*c*, the valve openings of the usage-side flow-rate-regulating valves 51*a*, 51*b*, 51*c* are regulated by the heat-source-side controller 20 so that the degree of superheating of refrigerant flowing through, e.g., the outlets of the usage-side heat exchangers 52*a*, 52*b*, 52*c* is brought to a predetermined value. In the usage unit 3*d*, the valve opening of the usage-side flow-rate-regulating valve 51*d* is regulated by the heat-source-side controller 20 so that the degree of subcooling of refrigerant flowing through, e.g., the outlet of the usage-side heat exchanger 52*d* is brought to a predetermined value.

In such a refrigerant circuit 10, a portion of the high-pressure gas refrigerant compressed and discharged by the compressor 21 is sent to the high/low-pressure gas-refrigerant communicating tube 8 by way of the high/low-pressure switching mechanism 30 and the high/low-pressure gas-side shut-off valve 32, another portion of the refrigerant is sent to the first heat-source-side heat exchanger 24 by way of the first heat-exchange-switching mechanism 22, and the remainder of the refrigerant is sent to the auxiliary heat-source-side heat exchanger 36 by way of the double-tube heat exchanger 35.

The high-pressure gas refrigerant sent to the high/low-pressure gas refrigerant communicating tube 8 is sent to the high-pressure gas connecting tube 63*d* of the connecting unit 4*d*. The high-pressure gas refrigerant sent to the high-pressure gas connecting tube 63*d* is sent to the usage-side heat exchanger 52*d* of the usage unit 3*d* through the high-pressure gas open/close valve 66*d* and the merging gas connecting tube 65*d*.

The high-pressure gas refrigerant sent to the usage-side heat exchanger 52*d* is then condensed in the usage-side heat exchanger 52*d* by heat exchange with indoor air supplied by the indoor fan 53*d*. Meanwhile, the indoor air is heated and supplied indoors, and the air-warming operation by the usage unit 3*d* is performed. After the flow rate of the refrigerant condensed in the usage-side heat exchanger 52*d* is regulated in the usage-side flow-rate-regulating valve 51*d*, the refrigerant is sent to the liquid connecting tube 61*d* of the connecting unit 4*d*.

The high-pressure gas refrigerant sent to the first heat-source-side heat exchanger 24 is also condensed in the first heat-source-side heat exchanger 24 by heat exchange with outdoor air supplied as a heat source by the outdoor fan 34. After the flow rate of the refrigerant condensed in the first heat-source-side heat exchanger 24 is regulated in the first heat-source-side flow-rate-regulating valve 26, the refrigerant is sent to the receiver 28 through the inlet non-return valve 29*a* and the receiver inlet open/close valve 28*c*. The refrigerant sent to the receiver 28 is temporarily accumulated in the receiver 28 and subjected to gas-liquid separation. The gas refrigerant thereafter undergoes heat exchange in the double-tube heat exchanger 35 by way of the receiver gas-venting tube 41 and is then vented away to the intake side of the compressor 21. The liquid refrigerant passes through the receiver outlet tube 28*b* and is sent to the liquid refrigerant communicating tube 7 by way of the outlet non-return valve 29*c* and the liquid-side shut-off valve 31. The refrigerant condensed in the double-tube heat exchanger 35 and the auxiliary heat-source-side heat exchanger 36 is merged partway along the receiver outlet tube 28*b*.

The refrigerant condensed in the usage-side heat exchanger 52*d* and sent to the liquid connecting tube 61*d* is then sent to the liquid refrigerant communicating tube 7, condensed in the first heat-source-side heat exchanger 24, and merged with the liquid refrigerant sent to the liquid refrigerant communicating tube 7.

The refrigerant merged in the liquid refrigerant communicating tube 7 is then branched into three streams and sent to the liquid connecting tubes 61*a*, 61*b*, 61*c* of the connecting units 4*a*, 4*b*, 4*c*. The refrigerant sent to the liquid connecting tubes 61*a*, 61*b*, 61*c* is then sent to the usage-side flow-rate-regulating valves 51*a*, 51*b*, 51*c* of the usage units 3*a*, 3*b*, 3*c*.

After the flow rate of the refrigerant sent to the usage-side flow-rate-regulating valves 51*a*, 51*b*, 51*c* is regulated in the usage-side flow-rate-regulating valves 51*a*, 51*b*, 51*c*, the refrigerant is evaporated in the usage-side heat exchangers 52*a*, 52*b*, 52*c* by heat exchange with indoor air supplied by the indoor fans 53*a*, 53*b*, 53*c*, and becomes low-pressure gas refrigerant. Meanwhile, the indoor air is cooled and supplied indoors, and air-cooling operation by the usage units 3*a*, 3*b*, 3*c* is performed. The low-pressure gas refrigerant is then sent to the merging gas connecting tubes 65*a*, 65*b*, 65*c* of the connecting units 4*a*, 4*b*, 4*c*.

The low-pressure gas refrigerant sent to the merging gas connecting tubes 65*a*, 65*b*, 65*c* is then sent to the low-pressure gas refrigerant communicating tube 9 through the low-pressure gas open/close valves 67*a*, 67*b*, 67*c* and the low-pressure gas communicating tubes 64*a*, 64*b*, 64*c* and merged.

The low-pressure gas refrigerant sent to the low-pressure gas refrigerant communicating tube 9 is then returned to the intake side of the compressor 21 through the low-pressure-gas-side shutoff valve 33.

Operation is carried out in this manner in the simultaneous air-cooling and air-warming operations (mainly evaporation load).

Although a detailed description is omitted, the target evaporation temperature is established in the simultaneous air-cooling and air-warming operations (mainly evaporation load) so that the compressor is able to process the air-cooling load in all the usage-side heat exchangers 52*a*, 52*b*, 52*c* functioning as refrigerant evaporators, the target condensation temperature is established so that the compressor is able to process the air-warming load in all the usage-side heat exchanger 52*d* functioning as a refrigerant condenser, and the frequency is controlled so that the target evaporation temperature and the target condensation temperature can both be achieved.

When the evaporation load of the usage-side heat exchangers 52*a*, 52*b*, 52*c*, 52*d* overall is reduced due to a fewer number of usage units (i.e., usage-side heat exchangers that function as refrigerant evaporators) that perform the air-cooling operation or for other reasons, it is possible to cause the second heat-source-side heat exchanger 25 to function as a refrigerant evaporator to thereby carry out an operation in which the condensation load of the first heat-source-side heat exchanger 24 and the evaporation load of the second heat-source-side heat exchanger 25 offset each other and the condensation load of the heat-source-side heat exchangers 24, 25 overall is reduced.

(2-4) Simultaneous Air-Cooling and Air-Warming Operations (Mainly Condensation Load)

Figure 6:
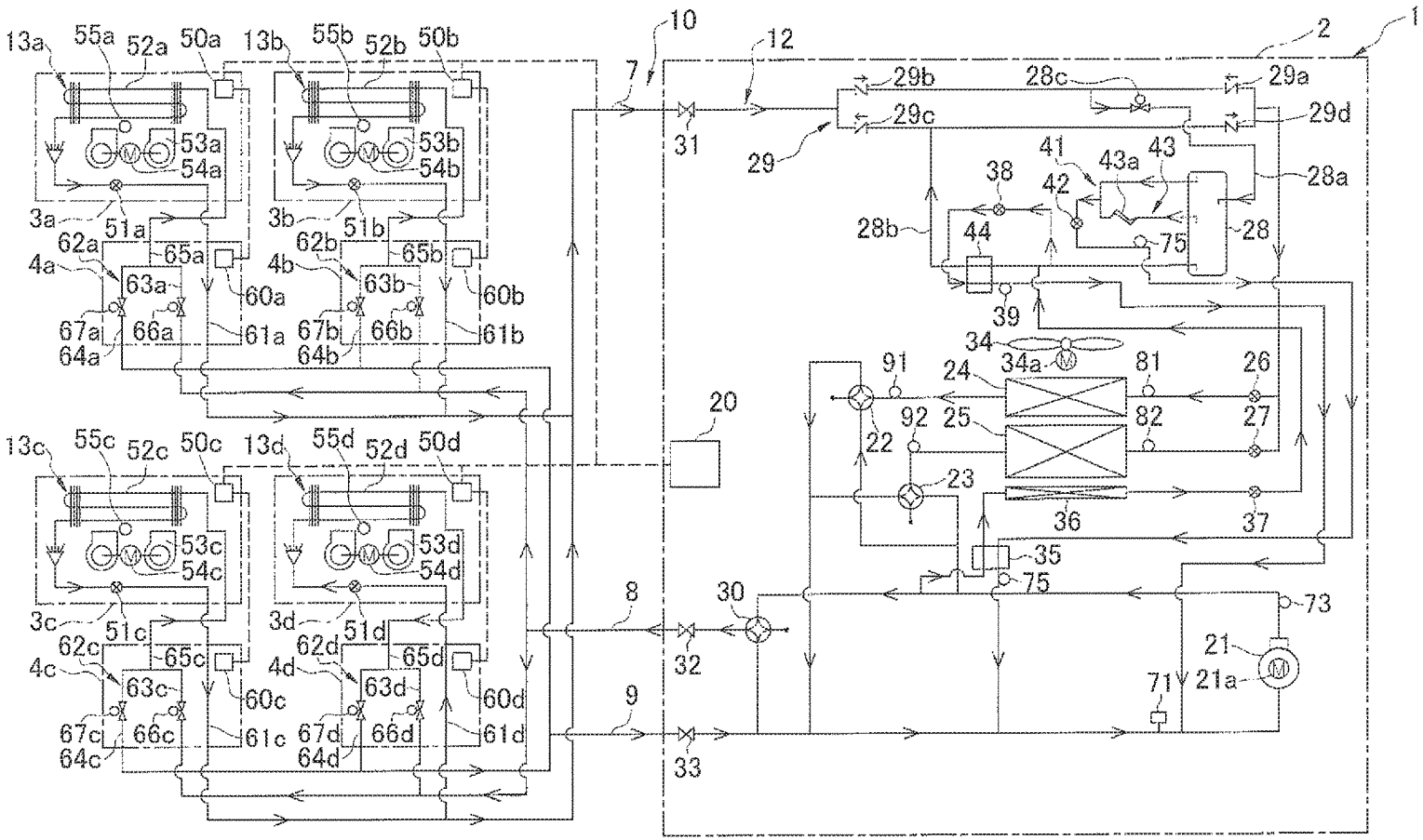
FIG. 6 is a view illustrating operation (refrigerant flow) in simultaneous cooling/warming operation (mainly condensation load)

During the simultaneous air-cooling and air-warming operations (mainly condensation load), e.g., when the usage units 3*a*, 3*b*, 3*c* perform the air-warming operation and the usage unit 3*d* performs the air-cooling operation (i.e., the usage-side heat exchangers 52*a*, 52*b*, 52*c* function as refrigerant condensers and the usage-side heat exchanger 52*d* functions as a refrigerant evaporator), and only the first heat-source-side heat exchanger 24 functions as a refrigerant evaporator, the refrigerant circuit 10 of the refrigerating apparatus 1 is configured in the manner shown in FIG. 6 (See: the arrows affixed to the refrigerant circuit 10 of FIG. 6 for the flow of refrigerant).

Specifically, in the heat source unit 2, the first heat-exchange switching mechanism 22 is switched to the evaporating operation state (state indicated by broken lines in the first heat-exchange switching mechanism 22 in FIG. 6), whereby only the first heat-source-side heat exchanger 24 is caused to function as a refrigerant evaporator. The high/low pressure switching mechanism 30 is also switched to a mainly-condensation-load operation state (state indicated by broken lines in the high/low pressure switching mechanism 30 in FIG. 6). The opening degree of the first heat-source-side flow-rate-regulating valve 26 is also regulated, the second heat-source-side flow-rate-regulating valve 27 is closed, and the receiver inlet open/close valve 28*c* is open. Regulating the valve opening of the auxiliary expansion valve 37 makes it possible to regulate the flow rate of refrigerant in the auxiliary heat-source-side heat exchanger 36. The valve opening of the gas-vent-side flow-rate-regulating valve 42 as a gas-vent-side flow-rate-regulating mechanism is regulated on the basis of the value detected by the gas-vent-side temperature sensor 75 so that wet refrigerant is inhibited from being taken into the compressor 21, thereby making it possible to regulate the amount of heat exchange in the double-tube heat exchanger 35, and to regulate the amount of gas refrigerant vented from the receiver 28 to the intake side of the compressor 21 by way of the receiver gas-venting tube 41. In addition, regulating the valve opening of the subcooling expansion valve 38 on the basis of the temperature detected by the subcooling sensor 39 makes it possible to regulate the degree of subcooling of the refrigerant flowing through the receiver outlet tube 28*b* at the outlet of the subcooling heat exchanger 44. In the connecting units 4*a*, 4*b*, 4*c*, 4*d*, the high-pressure gas open/close valves 66*a*, 66*b*, 66*c* and the low-pressure gas open/close valve 67*d* are placed in the open state and the high-pressure gas open/close valve 66*d* and the low-pressure gas open/close valve 67*a*, 67*b*, 67*c* are placed in the closed state, whereby the usage-side heat exchangers 52*a*, 52*b*, 52*c* of the usage units 3*a*, 3*b*, 3*c* are caused to function as refrigerant condensers, the usage-side heat exchanger 52*d* of the usage unit 3*d* is caused to function as a refrigerant evaporator, the usage-side heat exchanger 52*d* of the usage unit 3*d* and the intake side of the compressor 21 of the heat source unit 2 are connected via the low-pressure gas refrigerant communicating tube 9, and the usage-side heat exchangers 52*a*, 52*b*, 52*c* of the usage units 3*a*, 3*b*, 3*c* and the discharge side of the compressor 21 of the heat source unit 2 are connected via the high/low-pressure gas refrigerant communicating tube 8. In the usage units 3*a*, 3*b*, 3*c*, the valve openings of the usage-side flow-rate-regulating valves 51*a*, 51*b*, 51*c* are regulated by the heat-source-side controller 20 so that the degree of subcooling of refrigerant flowing through, e.g., the outlets of the usage-side heat exchangers 52*a*, 52*b*, 52*c* is brought to a predetermined value. In the usage unit 3*d*, the valve opening of the usage-side flow-rate-regulating valve 51*d* is regulated by the heat-source-side controller 20 so that the degree of superheating of refrigerant flowing through, e.g., the outlet of the usage-side heat exchanger 52*d* is brought to a predetermined value.

In such a refrigerant circuit 10, a portion of the high-pressure gas refrigerant compressed and discharged by the compressor 21 is sent to the high/low-pressure gas-refrigerant communicating tube 8 by way of the high/low-pressure switching mechanism 30 and the high/low-pressure gas-side shut-off valve 32, and the other portion of the refrigerant is sent to the auxiliary heat-source-side heat exchanger 36 by way of the double-tube heat exchanger 35.

The high-pressure gas refrigerant sent to the high/low-pressure gas refrigerant communicating tube 8 is then branched into three streams and sent to the high-pressure gas connecting tubes 63*a*, 63*b*, 63*c* of the connecting units 4*a*, 4*b*, 4*c*. The high-pressure gas refrigerant sent to the high-pressure gas connecting tubes 63*a*, 63*b*, 63*c* is sent to the usage-side heat exchangers 52*a*, 52*b*, 52*c* of the usage units 3*a*, 3*b*, 3*c* through the high-pressure gas open/close valves 66*a*, 66*b*, 66*c* and the merging gas connecting tubes 65*a*, 65*b*, 65*c*.

The high-pressure gas refrigerant sent to the usage-side heat exchangers 52*a*, 52*b*, 52*c* is then condensed in the usage-side heat exchangers 52*a*, 52*b*, 52*c* by heat exchange with indoor air supplied by the indoor fans 53*a*, 53*b*, 53*c*. Meanwhile, the indoor air is heated and supplied indoors, and the air-warming operation by the usage units 3*a*, 3*b*, 3*c* is performed. After the flow rate of the refrigerant condensed in the usage-side heat exchangers 52*a*, 52*b*, 52*c* is regulated in the usage-side flow-rate-regulating valves 51*a*, 51*b*, 51*c*, the refrigerant is sent to the liquid connecting tubes 61*a*, 61*b*, 61*c* of the connecting units 4*a*, 4*b*, 4*c*.

The refrigerant sent to the liquid connecting tubes 61*a*, 61*b*, 61*c*, 61*d* is then sent to the liquid refrigerant communicating tube 7 and merged.

A portion of the refrigerant that has merged in the liquid refrigerant communicating tube 7 is sent to the liquid connecting tube 61*d* of the connection unit 4*d*, and the remainder is sent to the receiver 28 by way of the liquid-side shut-off valve 31, the inlet non-return valve 29*b*, and the receiver inlet open/close valve 28*c*.

The refrigerant sent to the liquid connecting tube 61*d* of the connecting unit 4*d* is then sent to the usage-side flow-rate-regulating valve 51*d* of the usage unit 3*d*.

After the flow rate of the refrigerant sent to the usage-side flow-rate-regulating valve 51*d* is regulated in the usage-side flow-rate-regulating valve 51*d*, the refrigerant is evaporated in the usage-side heat exchanger 52*d* by heat exchange with indoor air supplied by the indoor fan 53*d*, and becomes low-pressure gas refrigerant. Meanwhile, the indoor air is cooled and supplied indoors, and air-cooling operation by the usage unit 3*d* is performed. The low-pressure gas refrigerant is then sent to the merging gas connecting tube 65*d* of the connecting unit 4*d*.

The low-pressure gas refrigerant sent to the merging gas connecting tube 65*d* is then sent to the low-pressure gas refrigerant communicating tube 9 through the low-pressure gas open/close valve 67*d* and the low-pressure gas connecting tube 64*d*.

The low-pressure gas refrigerant sent to the low-pressure gas refrigerant communicating tube 9 is then returned to the intake side of the compressor 21 through the low-pressure-gas-side shutoff valve 33.

The refrigerant sent to the receiver 28 is temporarily accumulated in the receiver 28 and subjected to gas-liquid separation. The gas refrigerant thereafter undergoes heat exchange in the double-tube heat exchanger 35 by way of the receiver gas-venting tube 41 and is then vented away to the intake side of the compressor 21. The liquid refrigerant passes through the receiver outlet tube 28*b* and is sent to the first heat-source-side flow-rate-regulating valve 26 by way of the outlet non-return valve 29*d*. The refrigerant condensed in the double-tube heat exchanger 35 and the auxiliary heat-source-side heat exchanger 36 is merged partway along the receiver outlet tube 28*b*. After the flow rate of the refrigerant sent to the first heat-source-side flow-rate-regulating valve 26 is regulated in the first heat-source-side flow-rate-regulating valve 26, the refrigerant is evaporated in the first heat-source-side heat exchanger 24 by heat exchange with outdoor air supplied by the outdoor fan 34, and becomes low-pressure gas refrigerant, and is sent to the first heat-exchange switching mechanism 22 The low-pressure gas refrigerant sent to the first heat-exchange switching mechanism 22 is then merged with the low-pressure gas refrigerant returned to the intake side of the compressor 21 through the low-pressure gas refrigerant communicating tube 9 and the low-pressure-gas-side shutoff valve 33, and is returned to the intake side of the compressor 21.

Operation is carried out in this manner in the simultaneous air-cooling and air-warming operations (mainly condensation load).

Although a detailed description is omitted, the target condensation temperature is established in the simultaneous air-cooling and air-warming operations (mainly condensation load) so that the compressor is able to process the air-warming load in all the usage-side heat exchangers 52*a*, 52*b*, 52*c* functioning as refrigerant condensers, a target evaporation temperature is established so that the compressor is able to process the air-cooling load in all the usage-side heat exchanger 52*d* functioning as a refrigerant evaporator, and the frequency is controlled so that the target condensation temperature and the target evaporation temperature can both be achieved.

When the condensation load of the usage-side heat exchangers 52*a*, 52*b*, 52*c*, 52*d* overall is reduced due to a decrease in the number of usage units (i.e., usage-side heat exchangers that function as refrigerant condensers) that perform an air-warming operation, or for other reasons, it is possible to cause the second heat-source-side heat exchanger 25 to function as a refrigerant condenser to thereby carry out an operation in which the evaporation load of the first heat-source-side heat exchanger 24 and the condensation load of the second heat-source-side heat exchanger 25 offset each other and the evaporation load of the heat-source-side heat exchangers 24, 25 overall is reduced.

Figure 7:
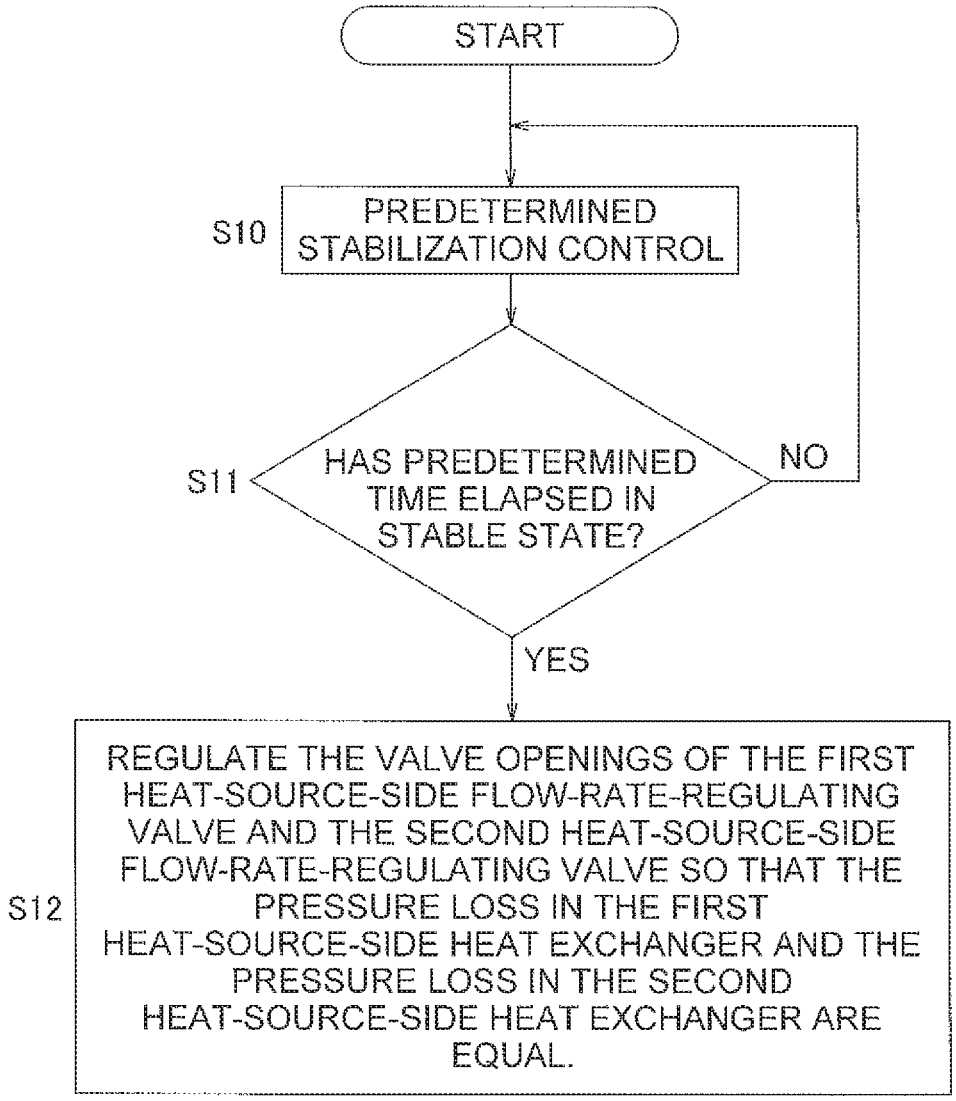
FIG. 7 is a flowchart related to the manner in which refrigerant flows to the first heat exchanger and the second heat exchanger during air-warming operation.

(3) Manner of Refrigerant Flow to First Heat-Source-Side Heat Exchanger 24 and the Second Heat-Source-Side Heat Exchanger 25 During the Air-Warming Operation FIG. 7 is a flowchart related to the manner in which refrigerant flows to the first heat-source-side heat exchanger 24 and the second heat-source-side heat exchanger 25 during the air-warming operation.

When the air-warming operation is started (including during restoration following a defrost operation), first, predetermined stabilization control for stabilizing the state of the refrigerant flowing through the refrigerant circuit 10 is carried out by the heat-source-side controller 20 (step S10), and thereafter branching control is carried out for optimizing the branching of refrigerant to the first heat-source-side heat exchanger 24 and the second heat-source-side heat exchanger 25.

In the predetermined stabilization control, the valve opening of the first heat-source-side flow-rate-regulating valve 26 and the valve opening of the second heat-source-side flow-rate-regulating valve 27 are regulated so that the degree of superheating of the refrigerant flowing through the outlet of the first heat-source-side heat exchanger 24 is equal to or greater than a predetermined value, and so that the degree of superheating of the refrigerant flowing through the outlet of the second heat-source-side heat exchanger 25 is equal to or greater than a predetermined value (step S10). In the present embodiment, the degree of superheating of the refrigerant flowing through the outlet of the first heat-source-side heat exchanger 24 is determined by subtracting the saturation temperature equivalent to the pressure detected by the intake pressure sensor 71 from the temperature detected by the first gas-side temperature sensor 91. The degree of superheating of the refrigerant flowing through the outlet of the second heat-source-side heat exchanger 25 is determined by subtracting the saturation temperature equivalent to the pressure detected by the intake pressure sensor 71 from the temperature detected by the second gas-side temperature sensor 92. The frequency is controlled so that the established target condensation temperature can be achieved so as to enable the compressor 21 to process the air-warming load in all of the usage-side heat exchangers 52*a*, 52*b*, 52*c*, 52*d* functioning as refrigerant condensers.

When a predetermined time or longer has elapsed with the degree of superheating of the refrigerant flowing through the outlet of the first heat-source-side heat exchanger 24 being equal to or greater than a predetermined value and the degree of superheating of the refrigerant flowing through the outlet of the second heat-source-side heat exchanger 25 being equal to or greater than a predetermined value (step S11), it is assessed that the state of the refrigerant has stabilized, the predetermined stabilization control is ended and the branching control is started. At this stage, the frequency of the compressor 21 is stable.

The following control is carried out in the branching control (step S13). First, considering the first heat-source-side heat exchanger 24 and the second heat-source-side heat exchanger 25 to be a single heat exchanger during the air-warming operation, the heat-source-side controller 20 determines the total flow rate of refrigerant that passes through the first heat-source-side heat exchanger 24 and the second heat-source-side heat exchanger 25 so that the refrigerant flowing through the outlet of the second heat-source-side heat exchanger 25 can be brought to a saturated gas state while the refrigerant flowing through the outlet of the first heat-source-side heat exchanger 24 is brought to a saturated gas state, and so that the discharge temperature of the refrigerant discharged from the compressor 21 reaches a discharge temperature that allows the target condensation temperature to be achieved. The heat-source-side controller 20 determines the total valve opening of the first heat-source-side flow-rate-regulating valve 26 and the second heat-source-side flow-rate-regulating valve 27 on the basis of the total refrigerant flow rate.

Next, the heat-source-side controller 20 performs the branching control in which the valve opening of the second heat-source-side flow-rate-regulating valve 27 is regulated while the valve opening of the first heat-source-side flow-rate-regulating valve 26 is regulated so that "the loss in pressure of the refrigerant before and after the first heat-source-side heat exchanger 24" is equal to "the loss in pressure of the refrigerant before and after the second heat-source-side heat exchanger 25" while the total valve opening condition of the first heat-source-side flow-rate-regulating valve 26 and the second heat-source-side flow-rate-regulating valve 27 is satisfied. In the present embodiment, the saturation pressure equivalent to the temperature detected by a first gas-liquid temperature sensor 81 can be determined because the refrigerant flowing through the portion to which the first gas-liquid temperature sensor 81 is provided is in a gas-liquid two-phase state of saturation, and the "the loss in pressure of the refrigerant before and after the first heat-source-side heat exchanger 24" can be determined by subtracting the pressure detected by the intake pressure sensor 71 from the saturation pressure. Similarly, the saturation pressure equivalent to the temperature detected by a second gas-liquid temperature sensor 82 can be determined because the refrigerant flowing through the portion to which the second gas-liquid temperature sensor 82 is provided is in a gas-liquid two-phase state of saturation, and the "the loss in pressure of the refrigerant before and after the second heat-source-side heat exchanger 25" can be determined by subtracting the pressure detected by the intake pressure sensor 71 from the saturation pressure.

In the present embodiment, the procedure for regulating the valve openings of the first heat-source-side flow-rate-regulating valve 26 and the second heat-source-side flow-rate-regulating valve 27 so that the "the loss in pressure of the refrigerant before and after the first heat-source-side heat exchanger 24" and "the loss in pressure of the refrigerant before and after the second heat-source-side heat exchanger 25" are equal involves predicting the ratio of the circulating amounts from the pressure losses on the basis of a general relationship in which the pressure difference before and after the heat exchanger is proportional to the square of the circulating amount, and regulating the valve openings of the first heat-source-side flow-rate-regulating valve 26 and the second heat-source-side flow-rate-regulating valve 27 by an amount commensurate to the predicted ratio of circulating amounts. The timing for performing such valve opening regulation is not particularly limited, and may be carried out, e.g., at predetermined time intervals.

(4) Characteristics of Refrigerating Apparatus 1

When the air-warming operation is being carried out in the refrigerating apparatus 1, the refrigerant flowing through the outlet of the second heat-source-side heat exchanger 25 is also brought to a saturated gas state while the refrigerant flowing through the outlet of the first heat-source-side heat exchanger 24 is brought to a saturated gas state, and therefore not only is it possible to use the entire area of the first heat-source-side heat exchanger 24 as an area for refrigerant evaporation, but the entire area of the second heat-source-side heat exchanger 25 can be used as an area for refrigerant evaporation. Accordingly, efficient operation is possible.

When the air-warming operation is being carried out in this manner in the refrigerating apparatus 1, the valve openings of the first heat-source-side flow-rate-regulating valve 26 and the second heat-source-side flow-rate-regulating valve 27 are regulated so that the refrigerant flowing through the outlet of the second heat-source-side heat exchanger 25 is also brought to a saturated gas state while the refrigerant flowing through the outlet of the first heat-source-side heat exchanger 24 is brought to a saturated gas state, whereupon the valve openings are regulated so as to obtain an amount of regulation that corresponds to the pressure loss that occurs in the first heat-source-side heat exchanger 24 and the second heat-source-side heat exchanger 25. Consequently, it is possible to reduce the time required to equalized the "pressure loss of the refrigerant before and after the first heat-source-side heat exchanger 24" and the "pressure loss of the refrigerant before and after the second heat-source-side heat exchanger 25."

Even if regulation to be carried out on the basis of information ascertained from the temperature of the refrigerant flowing through the outlet of the first heat-source-side heat exchanger 24 and the temperature of the refrigerant flowing through the outlet of the second heat-source-side heat exchanger 25 when the valve openings of the first heat-source-side flow-rate-regulating valve 26 and the second heat-source-side flow-rate-regulating valve 27 are to be regulated so that the refrigerant flowing through the outlet of the second heat-source-side heat exchanger 25 is also brought to a saturated gas state while the refrigerant flowing through the outlet of the first heat-source-side heat exchanger 24 is brought to a saturated gas state, it is not possible to compare the state of the refrigerant flowing through the outlet of the first heat-source-side heat exchanger 24 and the state of the refrigerant flowing through the outlet of the second heat-source-side heat exchanger 25 merely with the information ascertained from the temperature because there are various levels of possible dryness even with refrigerants in the same temperature state when the refrigerant in either of the outlets is in a gas-liquid two-phase state. In contrast, in the embodiment described above, determining the saturation pressure equivalent to the saturation temperature using the temperatures detected by the first gas-liquid temperature sensor 81 for detecting the temperature of refrigerant in a gas-liquid two-phase state of saturation and the second gas-liquid temperature sensor 82 for detecting the temperature of refrigerant in a gas-liquid two-phase state of saturation makes it possible to specify the pressure loss of refrigerant in the first heat-source-side heat exchanger 24 and the pressure loss of refrigerant in the second heat-source-side heat exchanger 25. Consequently, it is possible to compare the state of the refrigerant flowing through the outlet of the first heat-source-side heat exchanger 24 and the state of the refrigerant flowing through the outlet of the second heat-source-side heat exchanger 25.

The first gas-liquid temperature sensor 81 measures the temperature of refrigerant flowing from the first heat-source-side flow-rate-regulating valve 26 to the first heat-source-side heat exchanger 24, and the second gas-liquid temperature sensor 82 measures the temperature of refrigerant flowing from the second heat-source-side flow-rate-regulating valve 27 to the second heat-source-side heat exchanger 25, and both the first gas-liquid temperature sensor 81 and the second gas-liquid temperature sensor 82 are able to detect the temperature of refrigerant in a gas-liquid two-phase state after having been decompressed by the flow-rate-regulating valves 26, 27. Even if heat energy is added to the refrigerant in such a gas-liquid two-phase state, the heat energy is merely consumed as latent heat for causing a portion of the liquid refrigerant to evaporate, and the temperature of the refrigerant is unlikely to vary. Consequently, the temperature measured by the first gas-liquid temperature sensor 81 and the second gas-liquid temperature sensor 82 is stable and unlikely to vary, the first heat-source-side flow-rate-regulating valve 26 and second heat-source-side flow-rate-regulating valve 27, the valve openings of which are controlled on the basis thereof, are therefore unlikely to undergo a large change in valve opening, and regulation of the valve openings can be facilitated. Therefore, controlling the regulation of the valve opening of the first heat-source-side flow-rate-regulating valve 26 and the valve opening of the second heat-source-side flow-rate-regulating valve 27 can be carried out in a stable manner.

Furthermore, in the embodiment described above, the first gas-liquid temperature sensor 81 and the second gas-liquid temperature sensor 82 are used for regulating the valve openings of the first heat-source-side flow-rate-regulating valve 26 and the second heat-source-side flow-rate-regulating valve 27 so as to ensure a degree of subcooling of the refrigerant in the outlet of the first heat-source-side heat exchanger 24 and the outlet of the second heat-source-side heat exchanger 25 when the air-cooling operation is being carried out in the refrigerating apparatus 1. In the refrigerating apparatus 1, branching control during the air-warming operation can be carried out by making use of the first gas-liquid temperature sensor 81 and the second gas-liquid temperature sensor 82, which are used for controlling the degree of subcooling during the air-cooling operation.

(5) Other Embodiments

The preceding embodiment has been described as one example of embodiment of the present invention, but is in no way intended to limit the invention of the present application, which is not limited to the aforedescribed embodiment. The scope of the invention of the present application would as a matter of course include appropriate modifications that do not depart from the spirit thereof.

(5-1) Other Embodiment A

In the embodiment described above, an example was described in which branching control is carried out using the temperatures detected by the first gas-liquid temperature sensor 81 and the second gas-liquid temperature sensor 82.

Figure 8:
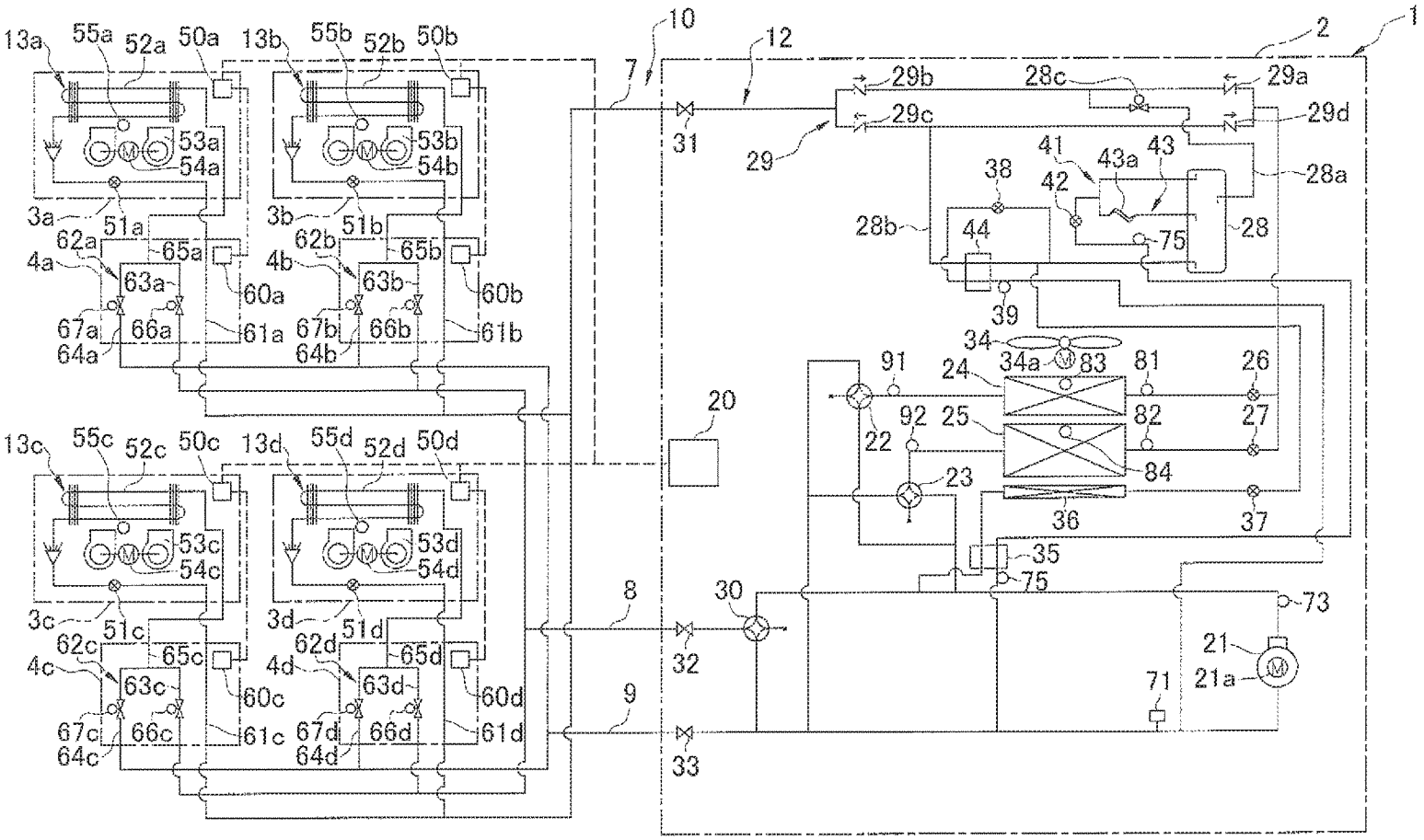
FIG. 8 is a schematic structural diagram of the refrigerating apparatus pertaining to another embodiment (5-1)

However, the embodiment is not provided by way of limitation of the present invention; it is also possible to, e.g., further provide a first intermediate temperature sensor 83 for detecting the temperature of refrigerant flowing through the interior of the first heat-source-side heat exchanger 24 and a second intermediate temperature sensor 84 for detecting the temperature of refrigerant flowing through the interior of the second heat-source-side heat exchanger 25, as shown in FIG. 8.

(5-2) Other Embodiment B

Figure 9:
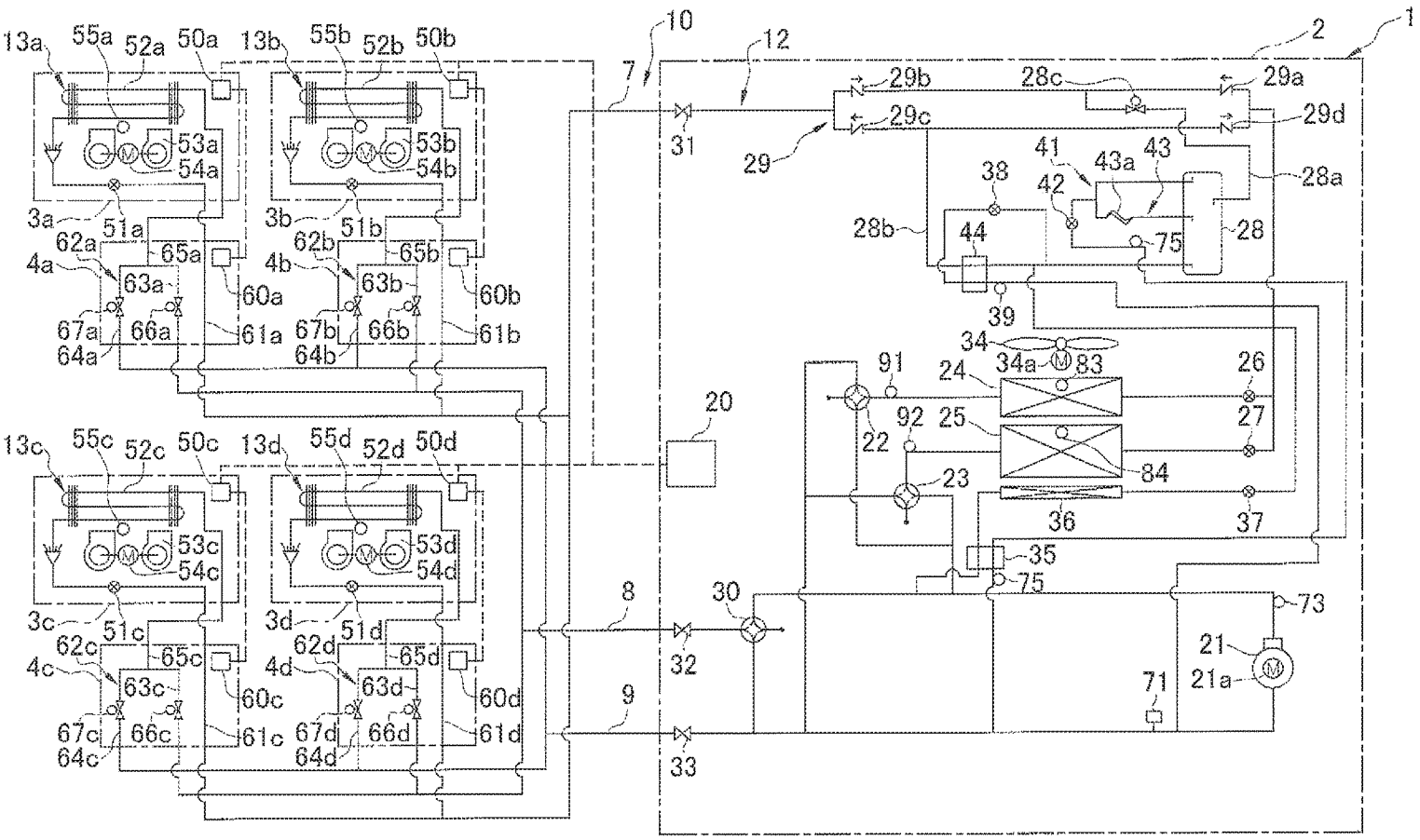
FIG. 9 is a schematic structural diagram of the refrigerating apparatus pertaining to another embodiment (5-2)

The first intermediate temperature sensor 83 for detecting the temperature of refrigerant flowing through the interior of the first heat-source-side heat exchanger 24 and the second intermediate temperature sensor 84 for detecting the temperature of refrigerant flowing through the interior of the second heat-source-side heat exchanger 25 may be provided in lieu of the first gas-liquid temperature sensor 81 and the second gas-liquid temperature sensor 82 of the embodiment described above, as shown in FIG. 9.

In this case as well, the first intermediate temperature sensor 83 is able to detect the saturation temperature of the gas-liquid two-phase state in the first heat-source-side heat exchanger 24 after the refrigerant has passed through the first heat-source-side flow-rate-regulating valve 26, and the second intermediate temperature sensor 84 is able to detect the saturation temperature of the gas-liquid two-phase state in the second heat-source-side heat exchanger 25 after the refrigerant has passed through the second heat-source-side flow-rate-regulating valve 27. Therefore, the heat-source-side controller 20 is able to ascertain the pressure loss of refrigerant in the first heat-source-side heat exchanger 24 by the difference in the pressure of the refrigerant equivalent to the saturation temperature detected by the first intermediate temperature sensor 83 and the pressure detected by the intake pressure sensor 71, and is able to ascertain the pressure loss of refrigerant in the second heat-source-side heat exchanger 25 by the difference in the pressure of the refrigerant equivalent to the saturation temperature detected by the second intermediate temperature sensor 84 and the pressure detected by the intake pressure sensor 71; making it possible to control the valve openings of the first heat-source-side flow-rate-regulating valve 26 and the second heat-source-side flow-rate-regulating valve 27 so that both pressure losses are equivalent.

(5-3) Other Embodiment C

Figure 10:
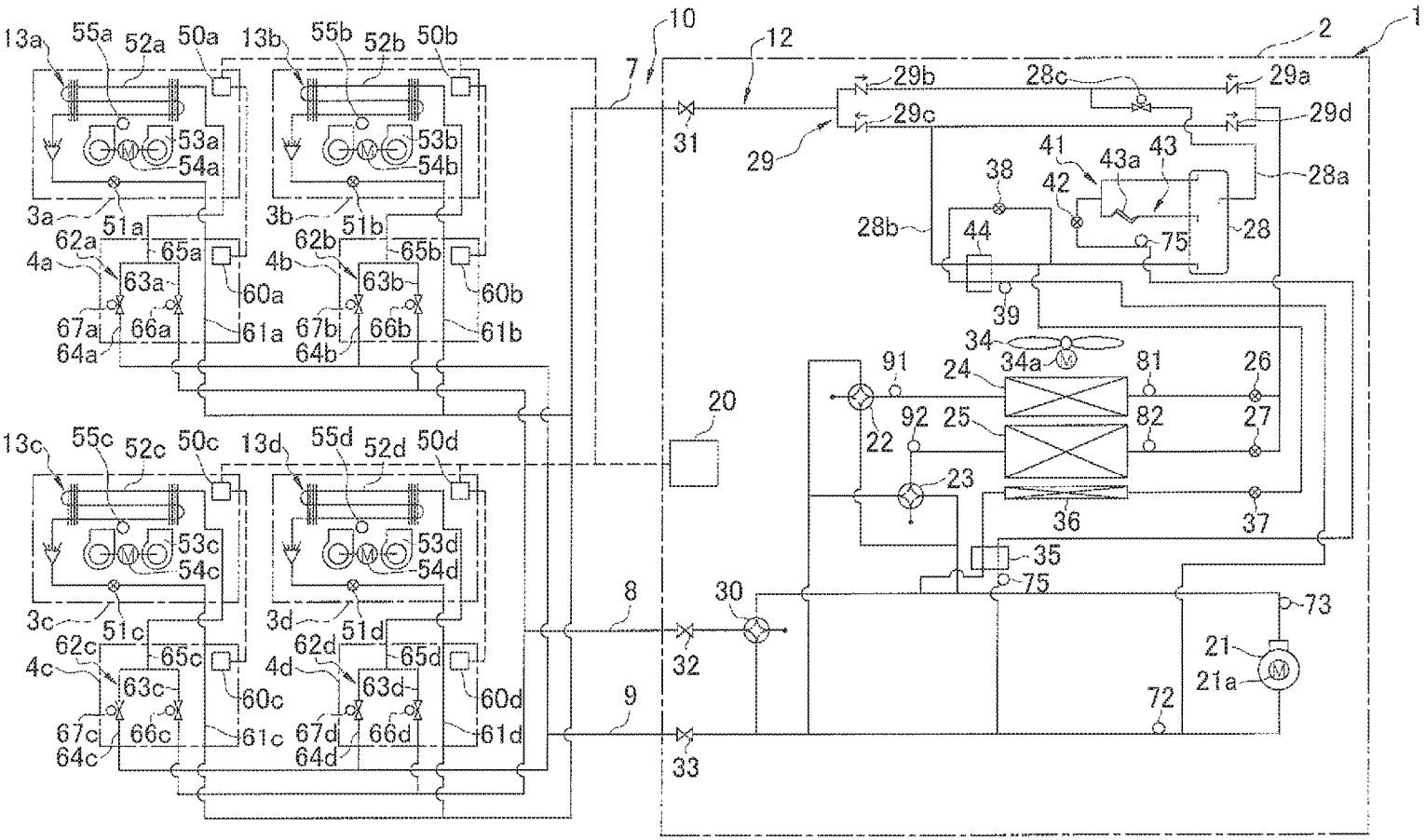
FIG. 10 is a schematic structural diagram of the refrigerating apparatus pertaining to another embodiment (5-3)

An intake temperature sensor 72 for detecting the temperature of refrigerant flowing through the inlet side of the compressor 21 may be provided in lieu of the intake pressure sensor 71 of the embodiment described above, as shown in FIG. 10.

In this case as well, the heat-source-side controller 20 is able to ascertain the pressure loss of refrigerant in the first heat-source-side heat exchanger 24 by the difference in the pressure of the refrigerant equivalent to the saturation temperature detected by the first gas-liquid temperature sensor 81 and the pressure equivalent to the temperature of refrigerant detected by the intake temperature sensor 72, and is able to ascertain the pressure loss of refrigerant in the second heat-source-side heat exchanger 25 by the difference in the pressure of the refrigerant equivalent to the saturation temperature detected by the second gas-liquid temperature sensor 82 and the pressure equivalent to the temperature detected by the intake temperature sensor 72; making it possible to control the valve openings of the first heat-source-side flow-rate-regulating valve 26 and the second heat-source-side flow-rate-regulating valve 27 so that both pressure losses are equivalent.

(5-4) Other Embodiment D

Figure 11:
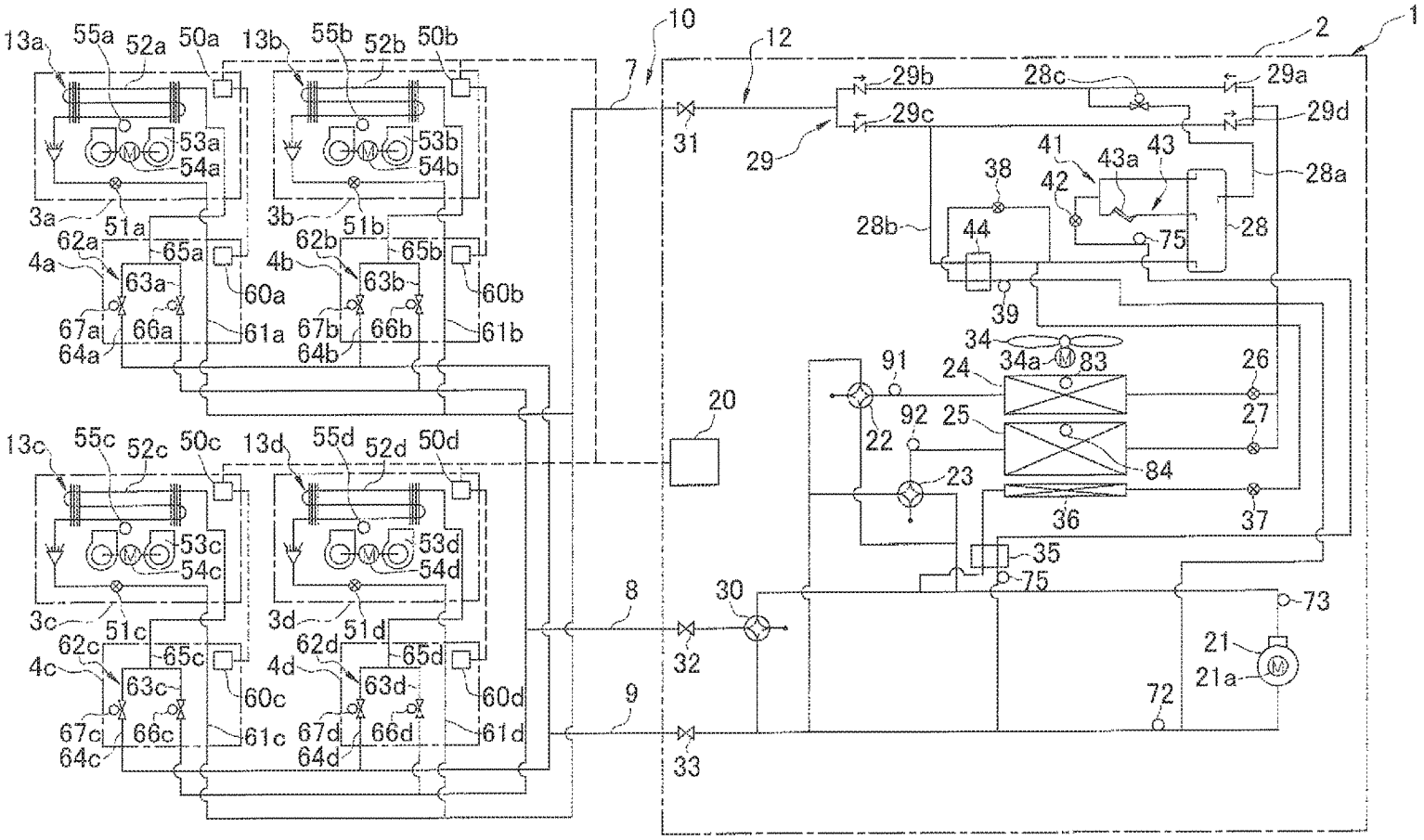
FIG. 11 is a schematic structural diagram of the refrigerating apparatus pertaining to another embodiment (5-4).

As shown in FIG. 11, the first intermediate temperature sensor 83 for detecting the temperature of refrigerant flowing through the interior of the first heat-source-side heat exchanger 24 and the second intermediate temperature sensor 84 for detecting the temperature of refrigerant flowing through the interior of the second heat-source-side heat exchanger 25 may be provided in lieu of the first gas-liquid temperature sensor 81 and the second gas-liquid temperature sensor 82 of the embodiment described above, while the intake temperature sensor 72 for detecting the temperature of refrigerant flowing through the intake side of the compressor 21 is also provided in lieu of the intake pressure sensor 71 of the embodiment described above.

In this case as well, the first intermediate temperature sensor 83 is able to detect the saturation temperature of the refrigerant in the gas-liquid two-phase state in the first heat-source-side heat exchanger 24 after the refrigerant has passed through the first heat-source-side flow-rate-regulating valve 26, and the second intermediate temperature sensor 84 is able to detect the saturation temperature of the refrigerant in the gas-liquid two-phase state in the second heat-source-side heat exchanger 25 after the refrigerant has passed through the second heat-source-side flow-rate-regulating valve 27. Therefore, the heat-source-side controller 20 is able to ascertain the pressure loss of refrigerant in the first heat-source-side heat exchanger 24 by the difference in the pressure of the refrigerant equivalent to the saturation temperature detected by the first intermediate temperature sensor 83 and the pressure equivalent to the temperature of the refrigerant detected by the intake temperature sensor 72, and is able to ascertain the pressure loss of refrigerant in the second heat-source-side heat exchanger 25 by the difference in the pressure of the refrigerant equivalent to the saturation temperature detected by the second intermediate temperature sensor 84 and the pressure equivalent to the temperature detected by the intake temperature sensor 72; making it possible to control the valve openings of the first heat-source-side flow-rate-regulating valve 26 and the second heat-source-side flow-rate-regulating valve 27 so that both pressure losses are equivalent.

(5-5) Other Embodiment E

In the embodiment described above, an example was described in which branching control is carried out for regulating the valve opening of the second heat-source-side flow-rate-regulating valve 27 while also regulating the valve opening of the first heat-source-side flow-rate-regulating valve 26 so that the "pressure loss of the refrigerant before and after the first heat-source-side heat exchanger 24" and the "pressure loss of the refrigerant before and after the second heat-source-side heat exchanger 25" are equalized.

However, the embodiment is not provided by way of limitation of the present invention. For example, the heat-source-side controller 20 may regulate the valve opening of the second heat-source-side flow-rate-regulating valve 27 while also regulating the valve opening of the first heat-source-side flow-rate-regulating valve 26 so that the temperature detected by the first gas-liquid temperature sensor 81 and the temperature detected by the second gas-liquid temperature sensor 82 are the same temperature.

In this case, the heat-source-side controller 20 reduces the valve openings of the heat-source-side flow-rate-regulating valves 26, 27 in response to the case in which the temperature detected by the first gas-liquid temperature sensor 81 and/or the second gas-liquid temperature sensor 82 is equal to or less than a predetermined reference temperature, and increases the valve openings of the heat-source-side flow-rate-regulating valves 26, 27 in response to the case in which the temperature detected by the first gas-liquid temperature sensor 81 and/or the second gas-liquid temperature sensor 82 is equal to or greater than a predetermined reference temperature (temperature may be higher than the former predetermined reference temperature), thereby making it possible to equalize the temperatures of the refrigerant decompressed in the heat-source-side flow-rate-regulating valves and thereafter moving toward the heat-source-side heat exchangers.

For example, the temperature detected by the first gas-liquid temperature sensor 81 and the temperature detected by the second gas-liquid temperature sensor 82 are compared, the valve openings of the heat-source-side flow-rate-regulating valves 26, 27 that corresponds to the gas-liquid temperature sensor that has detected a higher temperature are reduced, and the valve openings of the heat-source-side flow-rate-regulating valves 26, 27 that corresponds to the gas-liquid temperature sensor that has detected a lower temperature are increased, thereby making it possible to equalize the temperatures of the refrigerant that has been decompressed in the heat-source-side flow-rate-regulating valves and thereafter moving toward the heat-source-side heat exchangers.

What is claimed is:

1. A heat source unit connected to usage units to form a refrigerant circuit, the heat source unit comprising:

a compressor;

a first heat exchanger;

a second heat exchanger connected in parallel to the first heat exchanger;

a first motor-operated valve arranged to regulate an amount of refrigerant that flows to the first heat exchanger when the first heat exchanger operates as a refrigerant evaporator;

a second motor-operated valve arranged to regulate an amount of refrigerant that flows to the second heat exchanger when the second heat exchanger operates as a refrigerant evaporator;

a first temperature sensor arranged to measure a temperature of refrigerant flowing from the first motor-operated valve to the first heat exchanger;

a second temperature sensor arranged to measure a temperature of refrigerant flowing from the second motor-operated valve to the second heat exchanger;

a discharge temperature sensor arranged to measure a discharge temperature of refrigerant discharged from the compressor; and a valve opening controller configured to regulate a total valve opening of the first motor-operated valve and the second motor-operated valve based on the discharge temperature so that a total valve opening condition is satisfied, with the total opening being a sum of a valve opening of the first motor-operated valve and a valve opening of the second motor-operated valve, the valve opening controller being further configured to regulate the valve opening of the first motor-operated valve and the valve opening of the second motor-operated valve based on at least a value of the refrigerant temperature detected by the first temperature sensor and a value of the refrigerant temperature detected by the second temperature sensor while the total valve opening condition is satisfied.

2. The heat source unit according to claim 1, further comprising an intake pressure sensor arranged to measure an intake pressure of refrigerant taken in by the compressor, the valve opening controller being further configured to regulate the valve opening of the first motor-operated valve and the valve opening of the second motor-operated valve based on the intake pressure.

3. The heat source unit according to claim 2, wherein the valve opening controller is further configured to regulate the valve opening of the first motor-operated valve and the valve opening of the second motor-operated valve based on a difference between a refrigerant pressure equivalent to the temperature detected by the first temperature sensor and the intake pressure detected by the intake pressure sensor, and a difference between a refrigerant pressure equivalent to the temperature detected by the second temperature sensor and the intake pressure detected by the intake pressure sensor.

4. The heat source unit according to claim 1, further comprising an intake temperature sensor arranged to measure an intake temperature of refrigerant taken in by the compressor, the valve opening controller being further configured to regulate the valve opening of the first motor-operated valve and the valve opening of the second motor-operated valve based on a difference between a refrigerant pressure equivalent to the temperature detected by the first temperature sensor and a refrigerant pressure equivalent to the intake temperature detected by the intake temperature sensor, and a difference between a refrigerant pressure equivalent to the temperature detected by the second temperature sensor and the refrigerant pressure equivalent to the intake temperature detected by the intake temperature sensor.

5. The heat source unit according to claim 2, wherein the first temperature sensor is a first intermediate temperature sensor arranged to measure a temperature of refrigerant flowing through an interior of the first heat exchanger, the second temperature sensor is a second intermediate temperature sensor arranged to measure a temperature of refrigerant flowing through an interior of the second heat exchanger, and the valve opening controller is further configured to regulate the valve opening of the first motor-operated valve and the valve opening of the second motor-operated valve based on a difference between a refrigerant pressure equivalent to the temperature detected by the first intermediate temperature sensor and the intake pressure detected by the intake pressure sensor, and a difference between a refrigerant pressure equivalent to the temperature detected by the second intermediate temperature sensor and the intake pressure detected by the intake pressure sensor.

6. The heat source unit according to claim 1, further comprising an intake temperature sensor arranged to measure an intake temperature of refrigerant taken in by the compressor, the first temperature sensor being a first intermediate temperature sensor arranged to measure a temperature of refrigerant flowing through an interior of the first heat exchanger, the second temperature sensor being a second intermediate temperature sensor arranged to measure a temperature of refrigerant flowing through an interior of the second heat exchanger, and the valve opening controller being further configured to regulate the valve opening of the first motor-operated valve and the valve opening of the second motor-operated valve based on a difference between a refrigerant pressure equivalent to the temperature detected by the first intermediate temperature sensor and a refrigerant pressure equivalent to the intake temperature detected by the intake temperature sensor, and a difference between a refrigerant pressure equivalent to the temperature detected by the second intermediate temperature sensor and a refrigerant pressure equivalent to the intake temperature detected by the intake temperature sensor.

7. The heat source unit according to claim 3, wherein the valve opening controller is fluffier configured to regulate the valve opening of the first motor-operated valve and the valve opening of the second motor-operated valve so that a pressure loss of refrigerant passing through the first heat exchanger and a pressure loss of refrigerant passing through the second heat exchanger are equivalent.

8. The heat source unit according to claim 1, wherein the valve opening controller is further configured to regulate the valve opening of the first motor-operated valve and the valve opening of the second motor-operated valve so that the refrigerant temperature detected by the first temperature sensor and the refrigerant temperature detected by the second temperature sensor maintain a same temperature.

9. The heat source unit according to claim 1, further comprising a third temperature sensor arranged to measure a temperature of refrigerant flowing through an outlet of the first heat exchanger when the first heat exchanger operates as a refrigerant evaporator; and a fourth temperature sensor arranged to measure a temperature of refrigerant flowing through an outlet of the second heat exchanger when the second heat exchanger operates as a refrigerant evaporator, the valve opening controller being further configured to regulate the valve opening of the first motor-operated valve and the valve opening of the second motor-operated valve so that the refrigerant flowing through the outlet of the first heat exchanger and the refrigerant flowing through the outlet of the second heat exchanger each have a predetermined degree of superheating in an interval from a start of operation to cause the first heat exchanger and the second heat exchanger to operate as refrigerant evaporators until a predetermined stabilization condition is satisfied, and the valve opening of the first motor-operated valve and the valve opening of the second motor-operated valve based on the discharge temperature after the predetermined stabilization condition has been satisfied.

10. The heat source unit according to claim 4, wherein the valve opening controller is further configured to regulate the valve opening of the first motor-operated valve and the valve opening of the second motor-operated valve so that a pressure loss of refrigerant passing through the first heat exchanger and a pressure loss of refrigerant passing through the second heat exchanger are equivalent.

11. The heat source unit according to claim 5, wherein the valve opening controller is further configured to regulate the valve opening of the first motor-operated valve and the valve opening of the second motor-operated valve so that a pressure loss of refrigerant passing through the first heat exchanger and a pressure loss of refrigerant passing through the second heat exchanger are equivalent.

12. The heat source unit according to claim 6, wherein the valve opening controller is further configured to regulate the valve opening of the first motor-operated valve and the valve opening of the second motor-operated valve so that a pressure loss of refrigerant passing through the first heat exchanger and a pressure loss of refrigerant passing through the second heat exchanger are equivalent.

13. The heat source unit according to claim 2, further comprising a third temperature sensor arranged to measure a temperature of refrigerant flowing through an outlet of the first heat exchanger when the first heat exchanger operates as a refrigerant evaporator; and a fourth temperature sensor arranged to measure a temperature of refrigerant flowing through an outlet of the second heat exchanger when the second heat exchanger operates as a refrigerant evaporator, the valve opening controller being further configured to regulate the valve opening of the first motor-operated valve and the valve opening of the second motor-operated valve so that the refrigerant flowing through the outlet of the first heat exchanger and the refrigerant flowing through the outlet of the second heat exchanger each have a predetermined degree of superheating in an interval from a start of operation to cause the first heat exchanger and the second heat exchanger to operate as refrigerant evaporators until a predetermined stabilization condition is satisfied, and the valve opening of the first motor-operated valve and the valve opening of the second motor-operated valve based on the discharge temperature after the predetermined stabilization condition has been satisfied.

14. The heat source unit according to claim 3, further comprising a third temperature sensor arranged to measure a temperature of refrigerant flowing through an outlet of the first heat exchanger when the first heat exchanger operates as a refrigerant evaporator; and a fourth temperature sensor arranged to measure a temperature of refrigerant flowing through an outlet of the second heat exchanger when the second heat exchanger operates as a refrigerant evaporator, the valve opening controller being further configured to regulate the valve opening of the first motor-operated valve and the valve opening of the second motor-operated valve so that the refrigerant flowing through the outlet of the first heat exchanger and the refrigerant flowing through the outlet of the second heat exchanger each have a predetermined degree of superheating in an interval from a start of operation to cause the first heat exchanger and the second heat exchanger to operate as refrigerant evaporators until a predetermined stabilization condition is satisfied, and the valve opening of the first motor-operated valve and the valve opening of the second motor-operated valve based on the discharge temperature after the predetermined stabilization condition has been satisfied.

15. The heat source unit according to claim 4, further comprising a third temperature sensor arranged to measure a temperature of refrigerant flowing through an outlet of the first heat exchanger when the first heat exchanger operates as a refrigerant evaporator; and a fourth temperature sensor arranged to measure a temperature of refrigerant flowing through an outlet of the second heat exchanger when the second heat exchanger operates as a refrigerant evaporator, the valve opening controller being further configured to regulate the valve opening of the first motor-operated valve and the valve opening of the second motor-operated valve so that the refrigerant flowing through the outlet of the first heat exchanger and the refrigerant flowing through the outlet of the second heat exchanger each have a predetermined degree of superheating in an interval from a start of operation to cause the first heat exchanger and the second heat exchanger to operate as refrigerant evaporators until a predetermined stabilization condition is satisfied, and the valve opening of the first motor-operated valve and the valve opening of the second motor-operated valve based on the discharge temperature after the predetermined stabilization condition has been satisfied.

16. The heat source unit according to claim 5, further comprising a third temperature sensor arranged to measure a temperature of refrigerant flowing through an outlet of the first heat exchanger when the first heat exchanger operates as a refrigerant evaporator; and a fourth temperature sensor arranged to measure a temperature of refrigerant flowing through an outlet of the second heat exchanger when the second heat exchanger operates as a refrigerant evaporator, the valve opening controller being further configured to regulate the valve opening of the first motor-operated valve and the valve opening of the second motor-operated valve so that the refrigerant flowing through the outlet of the first heat exchanger and the refrigerant flowing through the outlet of the second heat exchanger each have a predetermined degree of superheating in an interval from a start of operation to cause the first heat exchanger and the second heat exchanger to operate as refrigerant evaporators until a predetermined stabilization condition is satisfied, and the valve opening of the first motor-operated valve and the valve opening of the second motor-operated valve based on the discharge temperature after the predetermined stabilization condition has been satisfied.

17. The heat source unit according to claim 6, further comprising a third temperature sensor arranged to measure a temperature of refrigerant flowing through an outlet of the first heat exchanger when the first heat exchanger operates as a refrigerant evaporator; and a fourth temperature sensor arranged to measure a temperature of refrigerant flowing through an outlet of the second heat exchanger when the second heat exchanger operates as a refrigerant evaporator, the valve opening controller being further configured to regulate the valve opening of the first motor-operated valve and the valve opening of the second motor-operated valve so that the refrigerant flowing through the outlet of the first heat exchanger and the refrigerant flowing through the outlet of the second heat exchanger each have a predetermined degree of superheating in an interval from a start of operation to cause the first heat exchanger and the second heat exchanger to operate as refrigerant evaporators until a predetermined stabilization condition is satisfied, and the valve opening of the first motor-operated valve and the valve opening of the second motor-operated valve based on the discharge temperature after the predetermined stabilization condition has been satisfied.

18. The heat source unit according to claim 7, further comprising a third temperature sensor arranged to measure a temperature of refrigerant flowing through an outlet of the first heat exchanger when the first heat exchanger operates as a refrigerant evaporator; and a fourth temperature sensor arranged to measure a temperature of refrigerant flowing through an outlet of the second heat exchanger when the second heat exchanger operates as a refrigerant evaporator, the valve opening controller being further configured to regulate the valve opening of the first motor-operated valve and the valve opening of the second motor-operated valve so that the refrigerant flowing through the outlet of the first heat exchanger and the refrigerant flowing through the outlet of the second heat exchanger each have a predetermined degree of superheating in an interval from a start of operation to cause the first heat exchanger and the second heat exchanger to operate as refrigerant evaporators until a predetermined stabilization condition is satisfied, and the valve opening of the first motor-operated valve and the valve opening of the second motor-operated valve based on the discharge temperature after the predetermined stabilization condition has been satisfied.

19. The heat source unit according to claim 8, further comprising a third temperature sensor arranged to measure a temperature of refrigerant flowing through an outlet of the first heat exchanger when the first heat exchanger operates as a refrigerant evaporator; and a fourth temperature sensor arranged to measure a temperature of refrigerant flowing through an outlet of the second heat exchanger when the second heat exchanger operates as a refrigerant evaporator, the valve opening controller being further configured to regulate the valve opening of the first motor-operated valve and the valve opening of the second motor-operated valve so that the refrigerant flowing through the outlet of the first heat exchanger and the refrigerant flowing through the outlet of the second heat exchanger each have a predetermined degree of superheating, in an interval from a start of operation to cause the first heat exchanger and the second heat exchanger to operate as refrigerant evaporators until a predetermined stabilization condition is satisfied, and the valve opening of the first motor-operated valve and the valve opening of the second motor-operated valve based on the discharge temperature after the predetermined stabilization condition has been satisfied.

* * * * *